US008944544B2

(12) United States Patent
Ishikawa et al.

(10) Patent No.: US 8,944,544 B2
(45) Date of Patent: Feb. 3, 2015

(54) PRINTING APPARATUS AND PRINTING METHOD

(75) Inventors: Kohei Ishikawa, Machida (JP); Tadashi Saito, Kawasaki (JP); Noritaka Nakashima, Nagareyama (JP)

(73) Assignee: Canon Finetech, Inc., Misato-shi (JP)

( * ) Notice: Subject to any disclaimer, the term of this patent is extended or adjusted under 35 U.S.C. 154(b) by 864 days.

(21) Appl. No.: 12/144,080

(22) Filed: Jun. 23, 2008

(65) Prior Publication Data

US 2009/0010663 A1 Jan. 8, 2009

(30) Foreign Application Priority Data

Jun. 28, 2007 (JP) ..... 2007-169893

(51) Int. Cl.

| | |
|---|---|
| ***B41J 3/00*** | (2006.01) |
| ***B41J 11/00*** | (2006.01) |
| ***B41J 13/00*** | (2006.01) |
| *B41J 11/42* | (2006.01) |
| *B41J 13/12* | (2006.01) |

(52) U.S. Cl.

CPC ..... *B41J 11/008* (2013.01); *B41J 11/0095* (2013.01); *B41J 13/0054* (2013.01); *B41J 11/42* (2013.01); *B41J 13/12* (2013.01)

USPC ..... 347/4; 347/104

(58) Field of Classification Search

CPC ..... B41J 11/0085; B41J 11/008; B41J 11/42; B41J 13/12

USPC ..... 347/101, 104, 105

See application file for complete search history.

(56) References Cited

U.S. PATENT DOCUMENTS

| | | | | |
|---|---|---|---|---|
| 6,128,098 | A * | 10/2000 | Kamada et al. | 358/1.8 |
| 6,149,259 | A * | 11/2000 | Otsuka et al. | 347/12 |
| 6,385,348 | B1 | 5/2002 | Harada | |
| 6,701,099 | B2 | 3/2004 | Yokobori et al. | |
| 6,810,219 | B2 | 10/2004 | Yokobori et al. | |
| 7,123,274 | B2 | 10/2006 | Komagamine et al. | |

(Continued)

FOREIGN PATENT DOCUMENTS

| | | |
|---|---|---|
| EP | 1 388 422 A2 | 2/2004 |
| JP | 6-135078 | 5/1994 |

(Continued)

OTHER PUBLICATIONS

European Search Report, dated Sep. 15, 2008, issued by the European Patent Office, in European Patent Application No. 08158848.5.

*Primary Examiner* — Ryan Lepisto
*Assistant Examiner* — Erin Chiem
(74) *Attorney, Agent, or Firm* — Fitzpatrick, Cella, Harper & Scinto

(57) ABSTRACT

The present invention provides a printing apparatus and a printing method which, even if print media of different sizes are printed, can print images in well-balanced, optimum layouts according to the size of each of the print media. Thus, the printing apparatus according to the present invention has leading end detector which detects a leading end of a print medium and trailing end detector which detects a trailing end of the print medium. The printing apparatus further has print control unit which prints images based on a first print data for which a print start position is determined on the basis of the leading end detected by the leading end detector and second print data for which a print start position is determined on the basis of the trailing end detected by the trailing end detector.

19 Claims, 40 Drawing Sheets

(56) References Cited

U.S. PATENT DOCUMENTS

| | | | | |
|---|---|---|---|---|
| 2001/0009615 | A1 | 7/2001 | Yokobori et al. | |
| 2001/0033050 | A1 | 10/2001 | Kinoshita et al. | 271/3.17 |
| 2003/0215252 | A1 | 11/2003 | Yokobori et al. | |
| 2004/0028450 | A1* | 2/2004 | Jung | 400/709 |
| 2004/0136734 | A1 | 7/2004 | Yokobori et al. | |
| 2005/0058486 | A1 | 3/2005 | Yamanaka | 400/76 |
| 2006/0212410 | A1* | 9/2006 | Tokarski et al. | 705/408 |
| 2007/0132803 | A1* | 6/2007 | Itoh | 347/19 |

FOREIGN PATENT DOCUMENTS

| | | | |
|---|---|---|---|
| JP | 9-168077 | | 6/1997 |
| JP | 11-242578 | A | 9/1999 |
| JP | 2001-265548 | A | 9/2001 |
| JP | 2002016833 | A | 1/2002 |
| JP | 2004-096560 | A | 3/2004 |

* cited by examiner

PRINT BUFFER A
(PRINT BUFFER FOR
LEADING END REFERENCE)

PRINT BUFFER B
(PRINT BUFFER FOR
TRAILING END REFERENCE)

PRINTING APPARATUS AND PRINTING METHOD

BACKGROUND OF THE INVENTION

1. Field of the Invention

The present invention relates to a printing apparatus and a printing method which print an image a print medium by conveying a print medium and determining a print timing for print data on the basis of positional information on the print medium being conveyed, the information being detected by a sensor configured to perform the detection.

2. Description of the Related Art

Many printing apparatuses and printing methods are known which involve an optical position detecting sensor for print media provided in a print medium conveying path to determine a print start timing for print data using as a print start reference a leading end detection information on the print medium obtained by the sensor so that printing of the print medium can be started at the determined print start timing.

Japanese Patent Laid-Open No. 6-135078 discloses a technique of determining whether a leading end or a trailing end of the print medium is used as a reference to set a print start position on the print medium so that if the front end of the print medium is used as the reference, the print start position on the print medium is placed at a print position after the front end has been detected, and so that if the rear end of the print medium is used as the reference, the print start position on the print medium is placed at the print position after the rear end has been detected.

However, with the conventional printing apparatus, printing is started at the print start position set on the basis of the leading end reference or trailing end reference of the print medium regardless of the size of the print medium in a conveying direction. Thus, if plural types of print media having different sizes in the print medium conveying direction are printed, then disadvantageously a plurality of image areas may be formed on the print medium in an unbalanced manner or the image may be partly missing.

For example, with the above-described printing apparatus, such a printing condition as shown in FIGS. 1 to 4 may occur. FIG. 1 is a schematic diagram of a monochromatic ink jet line printing apparatus equipped with a black ink ejecting line head (0105), showing that a post card (0101) as a print medium has been printed This printing apparatus performs one-pass printing by ejecting ink to a print medium (0101) passing under a line print head (0105). FIG. 1 shows that a recipient (an address and a name) (0102), a stamp positioning mark (0103), a sender (an address and a name) (0104) are appropriately printed on the postcard (0101). In contrast, if a postcard having a print medium length (the length in print medium conveying direction) different from that of the postcard shown in FIG. 1, such a printing condition as shown in FIGS. 2A and 2B may occur.

FIG. 2A shows that a postcard with a larger print medium length has been printed using the leading end as a reference. In this case, a margin at the trailing end (the bottom of the figure) of the postcard is excessively large as shown in FIG. 2A. FIG. 2B shows that a postcard with a larger print medium length has been printed using the trailing end as a reference. In this case, a margin at the trailing end (the top of the figure) of the postcard is excessively large as shown in FIG. 2B. FIG. 2C shows that a postcard with a smaller print medium length has been printed using the leading end as a reference. In this case, the sender name is partly missing. FIG. 2D shows that a postcard with a smaller print medium length has been printed using the trailing end as a reference. In this case, the name of the addressee is partly missing. Thus, printing by the conventional printing apparatus may result in unbalance between the print medium and the printed image.

FIG. 3 is a schematic diagram showing that an envelope (0301) pre-printed with an addressee (0302) has been printed using a color ink jet like printing apparatus equipped with a black ink ejecting line head (0306), a cyan ink ejecting line head (0307), a magenta ink ejecting line head (0308), and a yellow ink ejecting line head (0309). This printing apparatus performs one-pass printing by ejecting ink to the envelope (0301) passing under the line print head (0305).

FIG. 3 shows an example in which a postpaid postage mark (0303) and a sender (a company address, a company name, and a logo mark) (0304) are printed on the envelope (0301) by the above-described printing apparatus. In this example, the postpaid postage mark (0303) and the sender (0304) are appropriately printed by a printing operation using the leading end of the envelope as a reference. However, as shown in FIG. 4A, if an envelope with a larger print medium length is printed using the leading end thereof as a reference, the margin at the trailing end (the left of the figure) of the envelope may disadvantageously be excessively large, resulting in unbalance in the arrangement of the printed parts. Furthermore, as shown in FIG. 4B, if an envelope with a smaller print medium length is printed using the leading end thereof as a reference, the sender name may disadvantageously be partly missing.

On the other hand, Japanese Patent Laid-Open No. 9-168077 discloses a technique of printing an image using the leading end reference, and after the image formation, printing additional information (footer) using the trailing end reference. However, with the technique disclosed in Japanese Patent Laid-Open No. 9-168077, the image is always printed using the leading end reference, with the footer printed at a predetermined position located away from the area in which the image is printed. That is, the technique disclosed in Japanese Patent Laid-Open No. 9-168077 assumes that the print medium is large enough to allow both the image and footer to be printed thereon. Consequently, even with the technique disclosed in Japanese Patent Laid-Open No. 9-16807, a variation in the size of the print medium may still cause inconveniences such as the interference between the image, printed using the leading end reference, and the footer, missing of a part of the image, and the unbalanced arrangement of the image print parts.

SUMMARY OF THE INVENTION

The present invention has been made in view of the above-described problems. An object of the present invention is to provide a printing apparatus and a printing method which, even if print media of different sizes are printed, can print images in well-balanced, optimum layouts according to the size of each of the print media.

The present invention implements the following means to accomplish this object.

That is, a first aspect of the present invention provides a printing apparatus comprising leading end detecting means for detecting a leading end of each of plural types of print media of different sizes and trailing end detecting means for detecting a trailing end of the print medium, wherein the apparatus further comprises print control means for performing printing on the basis of first print data for which a print start position is determined on the basis of the leading end detected by the leading end detecting means and second print data for which a print start position is determined on the basis of the trailing end detected by the trailing end detecting means.

A second aspect of the present invention provides A printing method comprising: a leading end detecting step of detecting a leading end of a print medium, a trailing end detecting step of detecting a trailing end of the print medium; a first printing step of performing printing on the basis of first print data using the leading end detected in the leading end detecting step, as a reference position; and a second printing step of performing printing on the basis of second print data using the trailing end detected in the trailing end detecting step, as a reference position.

According to the present invention, even if print media having different sizes in a direction in which the print media are conveyed, well-balanced printing can be performed according to the size of each print medium.

Further features of the present invention will become apparent from the following description of exemplary embodiments (with reference to the attached drawings).

DESCRIPTION OF THE EMBODIMENTS

The best mode for carrying out the present invention will be described below in detail with reference to the drawings.

First Embodiment

Figure 1:
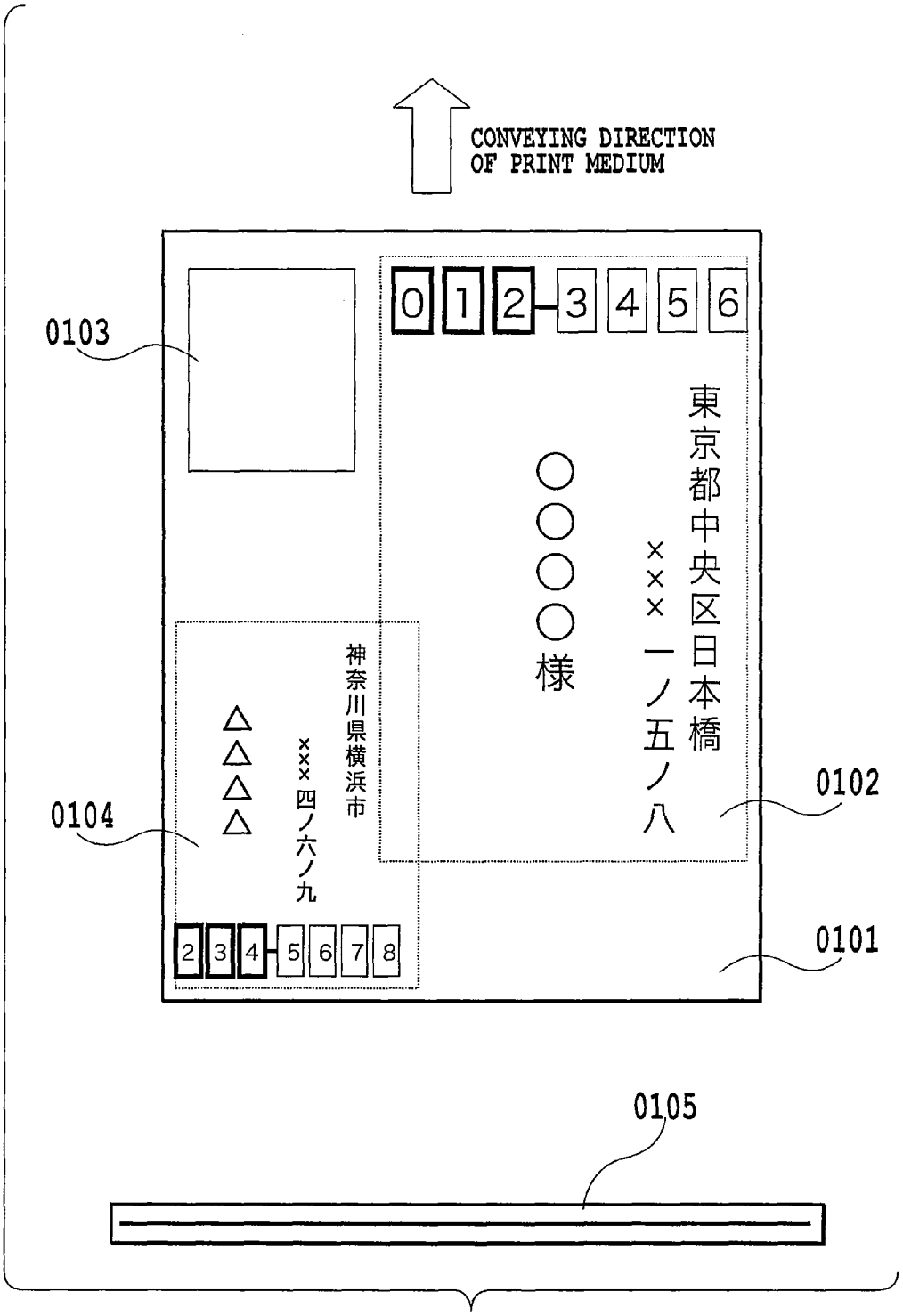
FIG. 1 is a schematic diagram showing that an appropriate image has been printed on a postcard by a conventional monochromatic ink jet line printing apparatus.
Figure 2A:
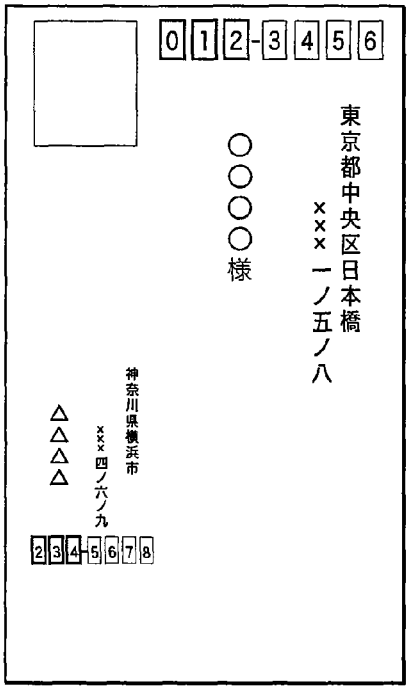
FIGS. 2A to 2D are diagrams showing the results of printing of postcards of various print medium length by the conventional monochromatic ink jet line printing apparatus.
Figure 2B:
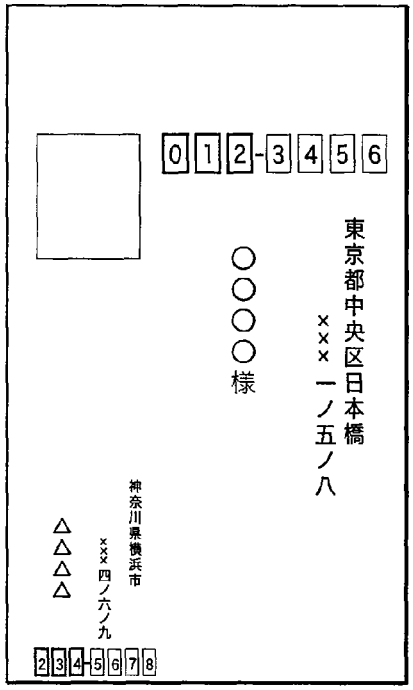
Figure 2C:
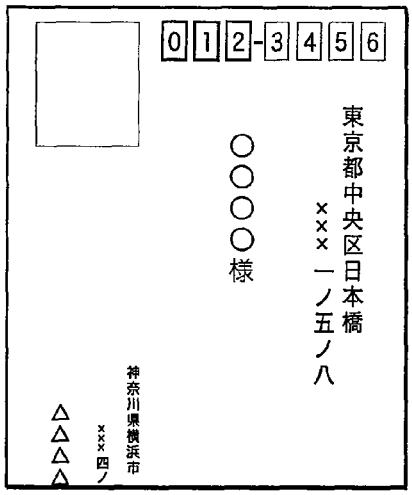
Figure 2D:
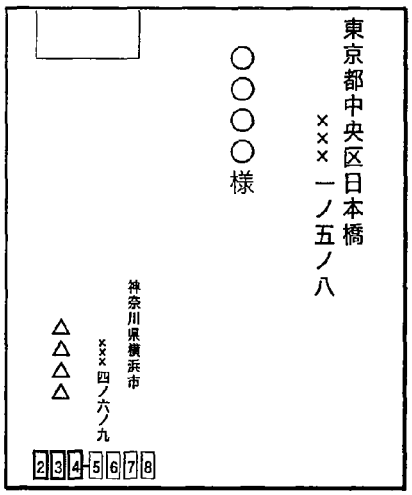
Figure 3:
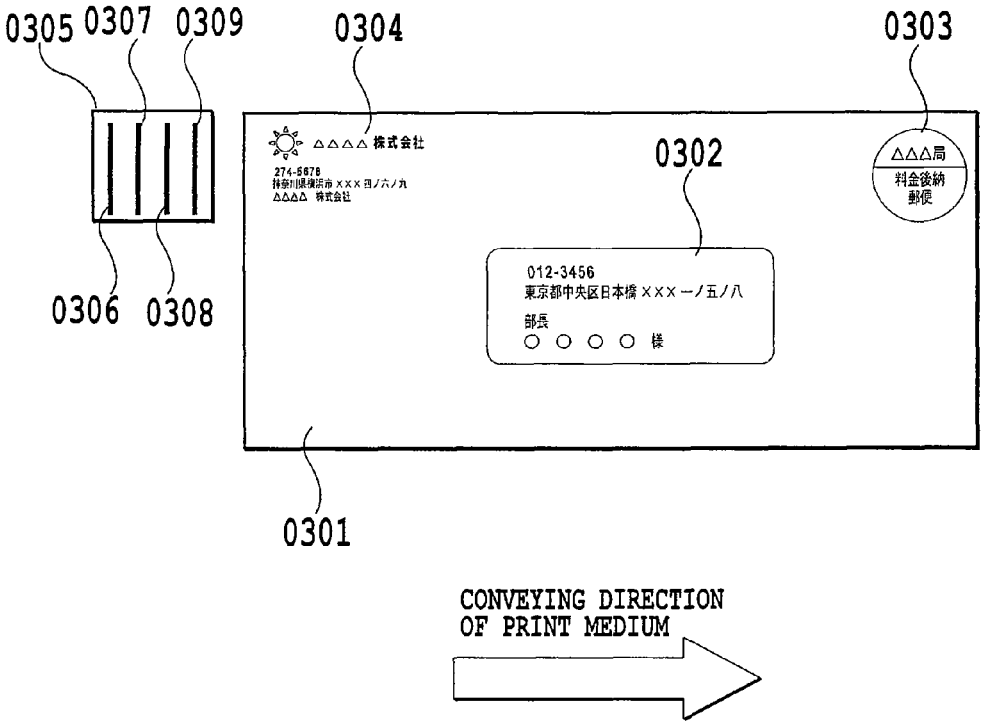
FIG. 3 is a diagram showing that an appropriate image has been printed on an envelope by a conventional color ink jet line printing apparatus.
Figure 4A:
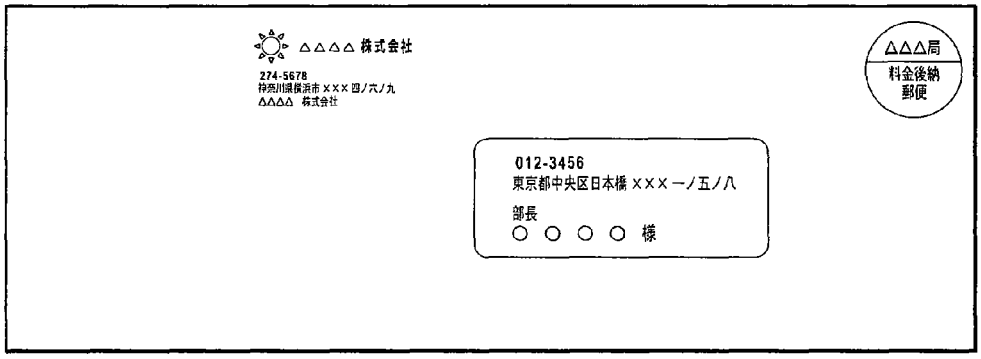
FIGS. 4A and 4B are diagrams showing the results of printing of envelopes of various print medium lengths by the conventional color ink jet line printing apparatus.
Figure 4B:
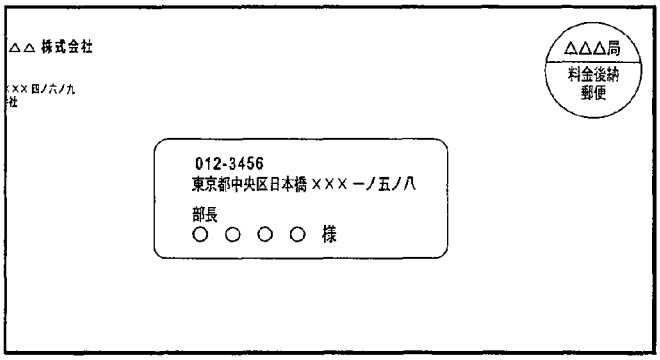
Figure 5:
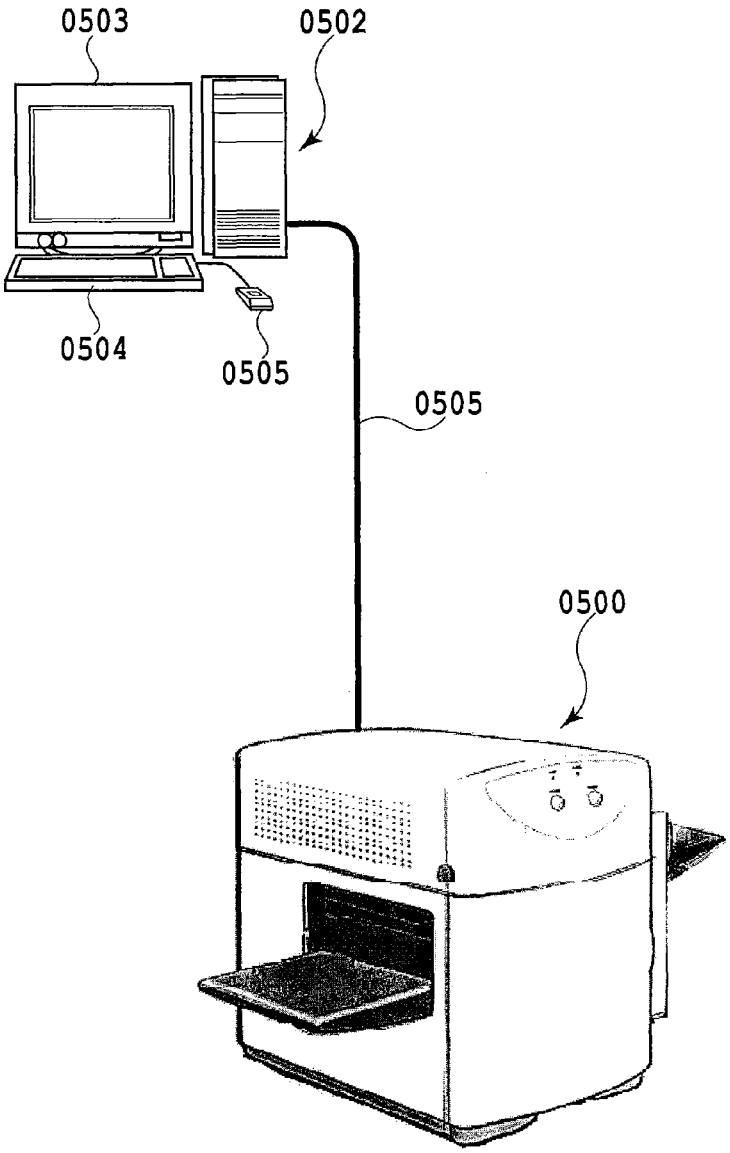
FIG. 5 is a schematic diagram showing an ink jet printing apparatus to which a first embodiment is applied and a PC connected to the ink jet printing apparatus.

FIG. 5 shows a card printing apparatus (hereinafter referred to as a "printing apparatus") a personal computer (hereinafter referred to as a "PC") which are used in the present embodiment; the card printing apparatus uses a line print head based on an ink jet method (hereinafter referred to as a "print head"), and the personal computer is connected to the card printing apparatus.

The PC is composed of a PC control device (0502), a display section (hereinafter referred to as a "CRT") (0503), a keyboard input section (0504), and a mouse input section (0505). The printing apparatus (0500) and the PC control device (0502) are connected together by a printer cable (0501). The printing apparatus (0500) allows the PC control device (0502) to receive various control commands via a printer cable (0501) for processing.

Figure 6:
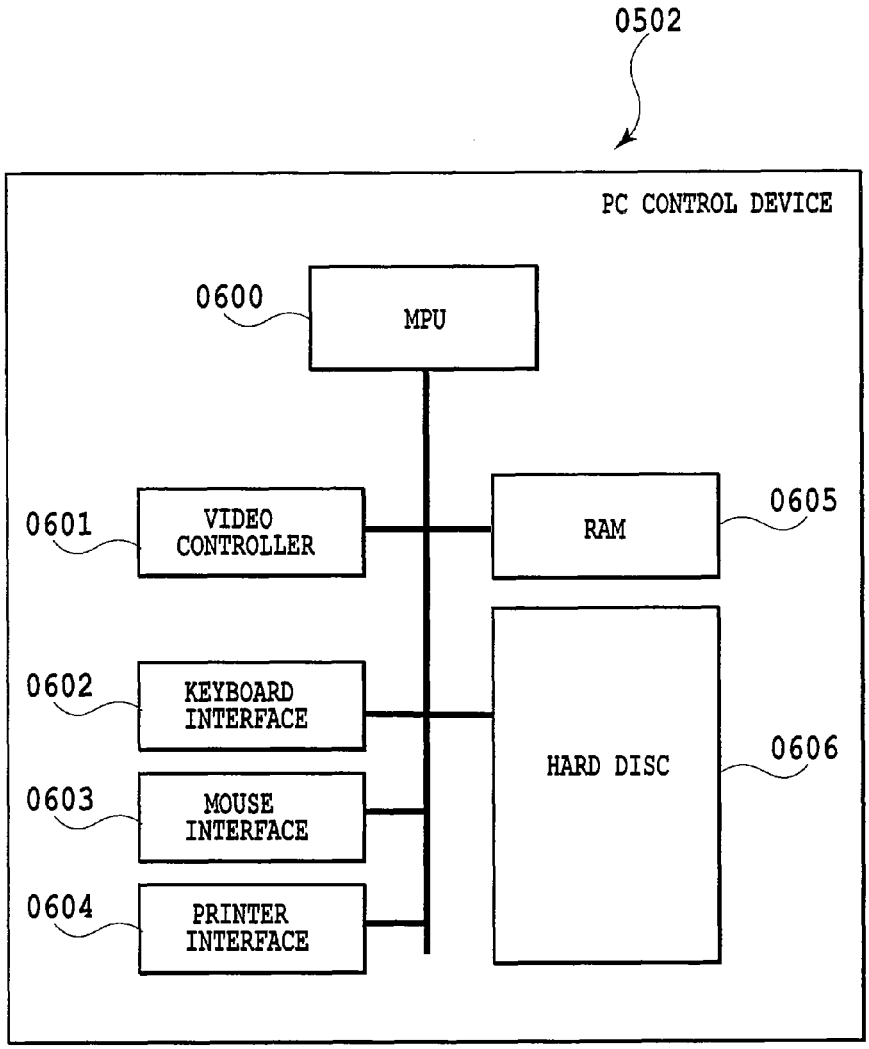
FIG. 6 is a block diagram of a PC control device used in the first embodiment.

FIG. 6 shows a block diagram of the PC control device (0502) used in the present embodiment. The keyboard (0504) as input means is connected to the PC control device (0502) via a keyboard interface (0602). The mouse (0505) is connected to the PC control device (0502) via a mouse interface (0603). The CRT (0503) is connected to the PC control deice via a video controller (0601).

The PC control device (0502) executes, for example, a process in which a microprocessor unit (0600) (hereinafter an MPU 600) executes print data creating application on a hard disc (0606), in a RAM (0605) to create print data, and a process of converting print data into a control command to output the control command to the printer cable (0501) via a printer interface (0604).

Figure 7:
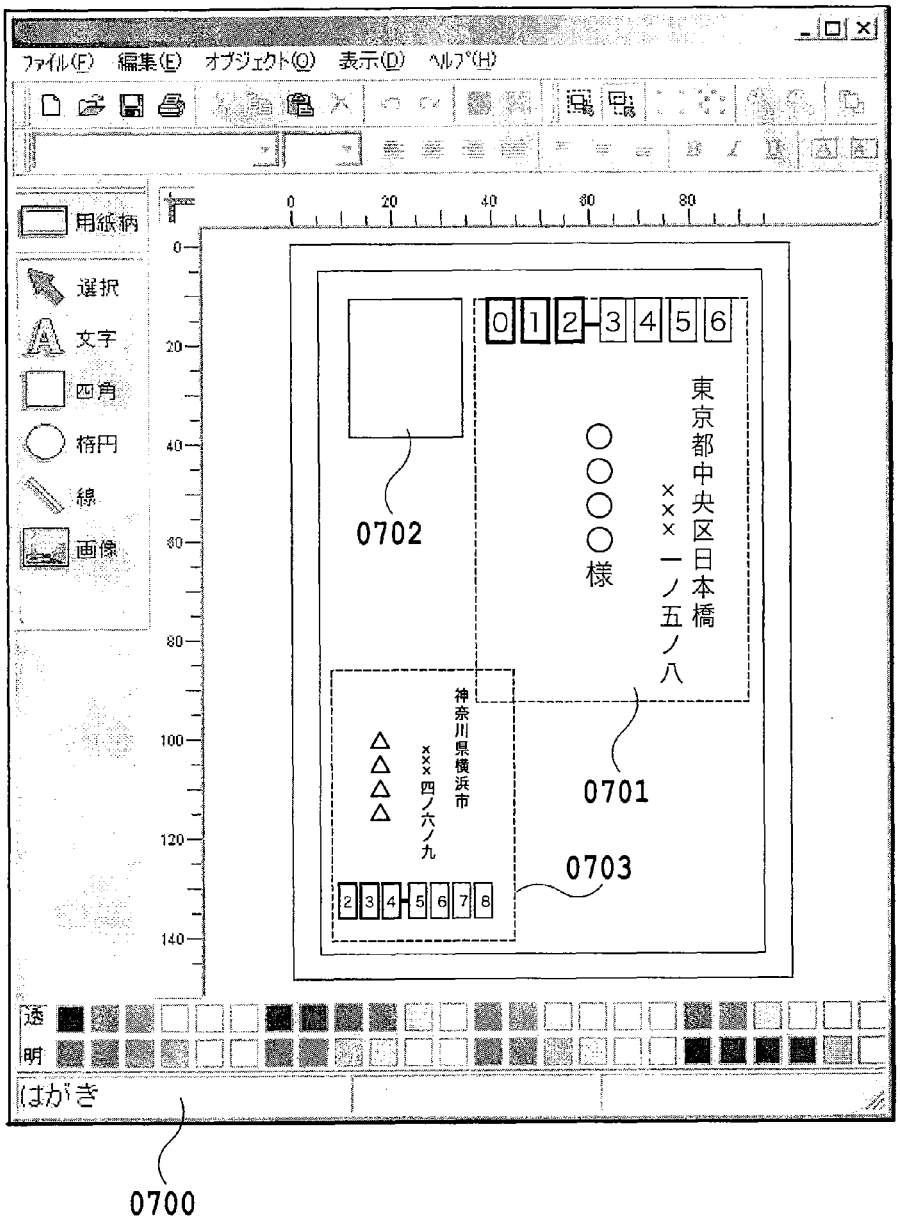
FIG. 7 is a diagram showing a print data layout creation screen displayed on a display section by application software used in the first embodiment.

FIG. 7 is a diagram showing a print data layout creation screen (0700) in which the application software executed by the PC control device (0502) used in the present embodiment.

A user operates the keyboard (0504) and the mouse (0505) to start the print data application software on the hard disc (0606). Then, the MPU (0600) in the PC control device (0502) executes the print data creating application software on the hard disc (0606), in the RAM (0605). The application software then displays a print data layout creation screen (0700) on the CRT (0503). On the print data layout creation screen (0700), the user can perform operations of newly creating, editing, and deleting text data and image data contained in print data. The user can further set a print reference position (leading end reference/trailing end reference) for each text or image data. In the present embodiment, the print reference position for a recipient (0701) and a stamp positioning mark (0702) is set to be the "leading end reference". The print reference position for a sender (0703) is set to be the "trailing end reference".

Figure 8A:
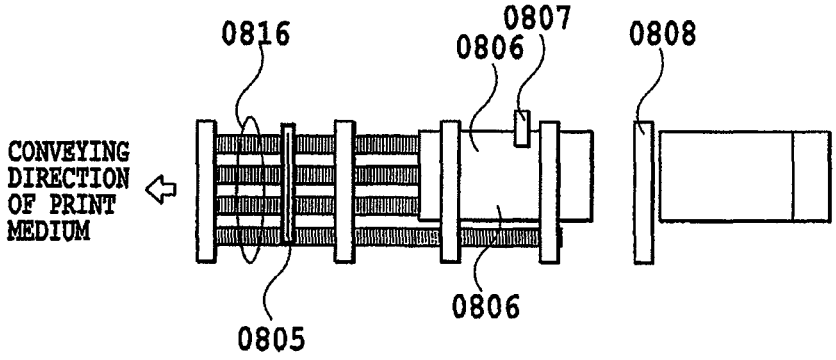
FIG. 8A is a top view showing a general configuration of the ink jet printing apparatus according to the first embodiment.
Figure 8B:
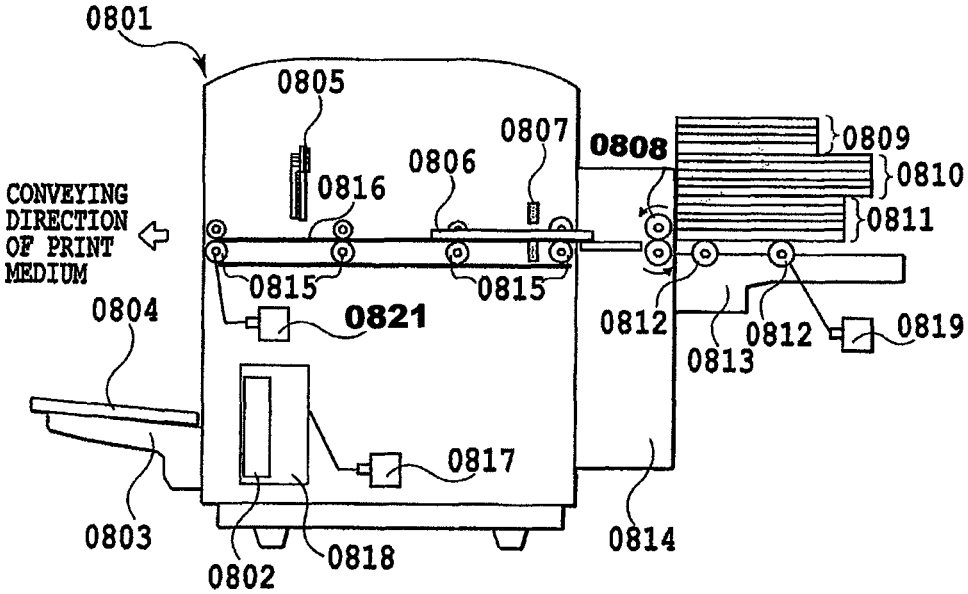
FIG. 8B is a vertically sectional side view showing the general configuration of the ink jet printing apparatus according to the first embodiment.

FIGS. 8A and 8B are a plan view and a vertically sectional side view, respectively, showing a general configuration of the printing apparatus used in the present embodiment.

The printing apparatus (0500) includes a printing section (0801), a sheet feeding section (0814), and a sheet discharging tray (0803).

The sheet feeding section (0814) is composed of a sheet feeding tray (0813) on which print media (0809, 0810, 0811) are stacked, a feed roller (0812) that feeds the print media stacked on the sheet feeding tray (0813), starting with those located at the bottom of the stack, and a separation feed roller (0808) that separates one of the print media fed by the sheet feed roller and feeds this print medium to printing section (0801). A lower roller of the separation feed roller (0808) rotates in a direction in which the print medium is conveyed to the printing section (0801). In contrast, the upper roller rotates in a direction in which the print medium is conveyed to the sheet feeding tray (0813). Thus, the lowermost one of the print media stacked on the sheet feeding tray (0813) is reliably separated from the others and fed to the printing section (0801). In the illustrated example, the following three types of print media are mixedly stacked on the sheet feeding tray (0813): the print media (0811) of a normal size, the print media (0810) larger than the normal size, and the print media (0809) smaller than the normal size. The sheet feeding rollers (0812) and (0808) are driven by a sheet feeding motor (0819).

The printing section (0801) is composed of a conveying belt (0816) on which the print medium (0806) is conveyed, a conveying roller (0815) that drives the conveying belt, a conveying motor (0821) that drives the conveying roller, a position detecting sensor (0807) that optically detects the position of the print medium being conveyed, a print head (0805) that ejects ink, an ink tank unit (0818) that supplies ink (in this case, black ink) stored in the ink tank (0802), to the print head (0805) via a tube (not shown), and a pump motor (0817) that drives the ink tank unit (0818).

The leading and trailing ends of the print medium (0806) being conveyed by the conveying belt are detected by the position detecting sensor (0807). On the basis of positional information output by the detecting sensor (0807), the MPU, described below and provided in the printing apparatus, allows the print head (0805) to eject ink in accordance with an image formation signal. The ink is thus ejected onto a surface of the print medium to form an image. The printed print medium (0804) discharged by the printing section (0801) is stacked on the sheet discharging tray (0803).

Figure 9A:
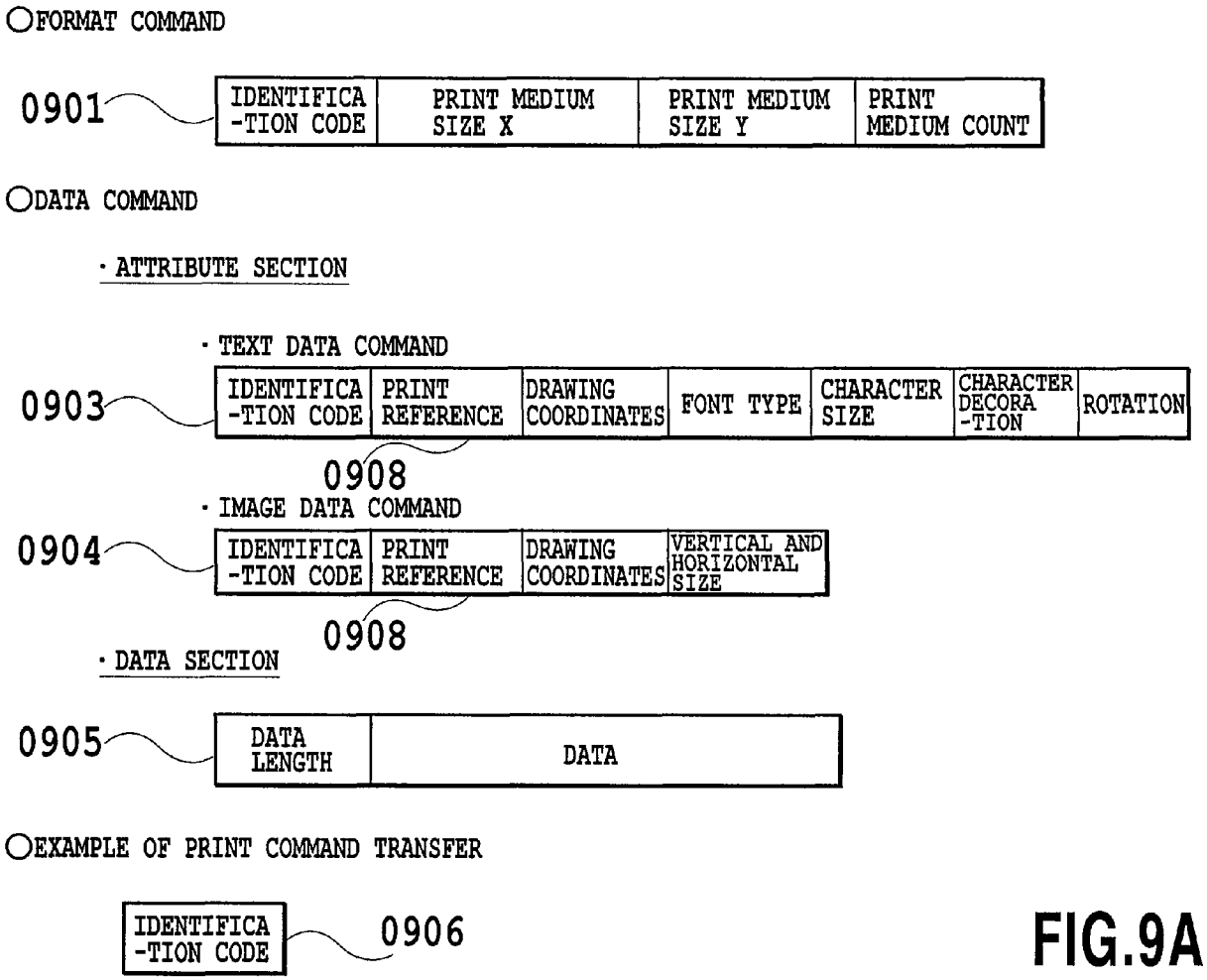
FIG. 9A is a diagram illustrating a control command system used in the ink jet printing apparatus according to the first embodiment.

FIG. 9A shows the structure of control commands used in the present embodiment.

The control commands include a format command (0901) specifying a print size X (the size of print data in a direction in which nozzles are arranged in the print head), a print size Y (the size of the print data in a direction in which the print medium is conveyed), a format command (0901) specifying the number of print media to be printed, a text data command (0903) containing a print reference specification (0908) and various attributes of the text data of the print data, an image data command (0904) containing the print reference specification (0908) and various attributes of the image data, a data section (0905) for the text data and the image data, and a print start command (0906) that starts printing.

Figure 9B:
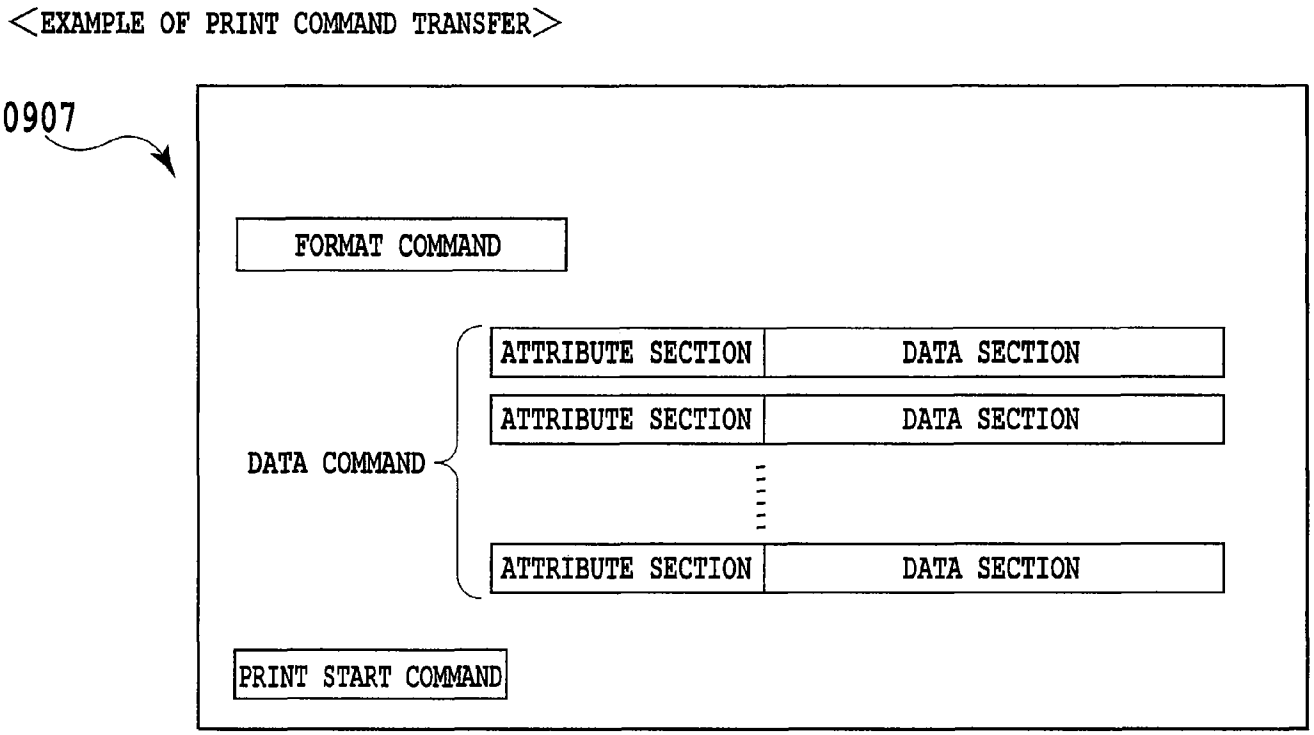
FIG. 9B is a diagram showing an example of transfer of a print command used in the ink jet printing apparatus according to the first embodiment.

These control commands are transferred from the PC control device (0502) to the printing apparatus (0500) via the printer cable (0501) as shown in an example of transfer in FIG. 9B. In the present embodiment, the print reference position specification (0908), which is present in each of the text and image data, indicates whether the print reference for the print medium is the leading end or the trailing end. The print reference position specification (0908) of "0" indicates that the image data is to be printed using the leading end of the print medium as a reference. The print reference position specification (0908) of "1" indicates that the image data is to be printed using the trailing end of the print medium as a reference.

Figure 10:
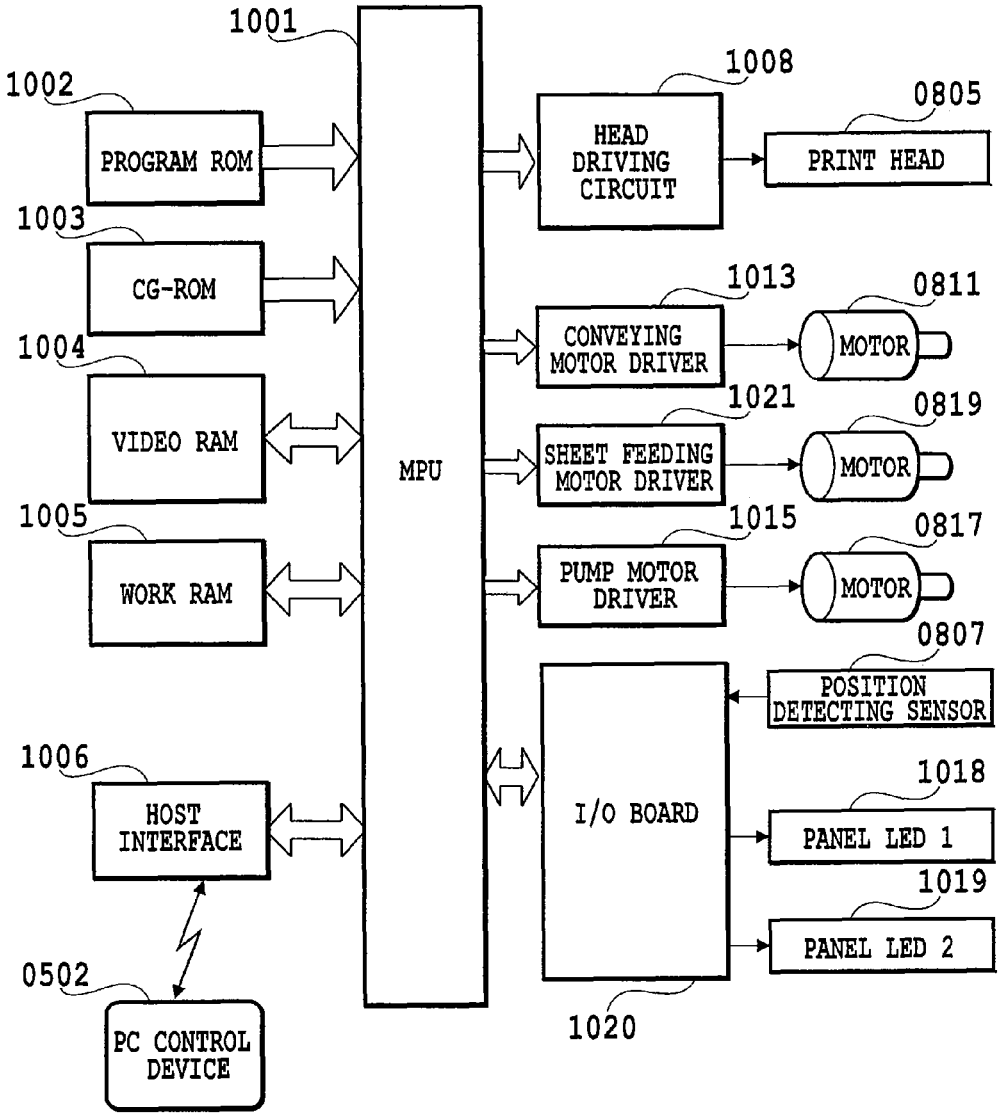
FIG. 10 is a block diagram showing a control system in the ink jet printing apparatus according to the first embodiment.
Figure 11A:
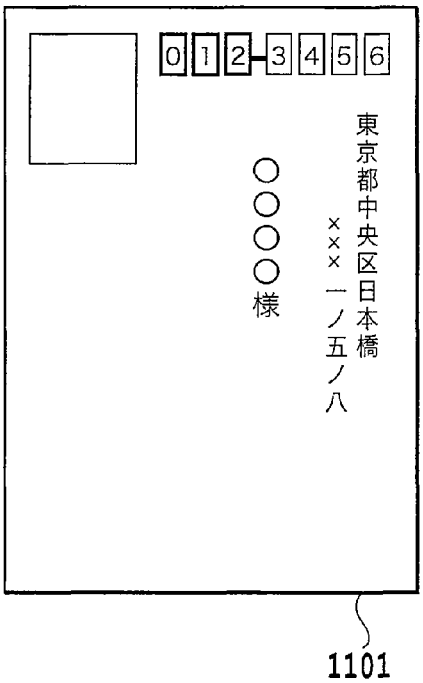
FIG. 11A is a diagram conceptually showing leading end-based print data stored in a print buffer in the ink jet printing apparatus according to the first embodiment.
Figure 11B:
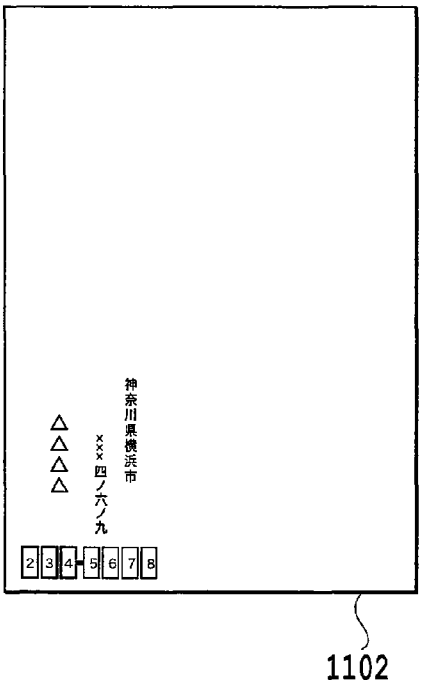
FIG. 11B is a diagram conceptually showing tailing-end-based print data stored in a print buffer B in the ink jet printing apparatus according to the first embodiment.

FIGS. 11A and 11B show the structure of a print buffer used in the present embodiment. A print buffer A (1101) and a print buffer B (1102) are present on a video RAM (1004: see FIG. 10, described below); the print buffer A is a print buffer (leading end reference print buffer) storing data corresponding to images to be printed using the leading end reference, and the print buffer B (1102) is a print buffer (trailing end reference print buffer) that expands data corresponding to images to be printed using the trailing end reference. The size of the print buffer is determined by the print sizes X and Y in the format command (0901), described above.

FIG. 10 shows a block diagram of a control system in the printing apparatus (0500) according to the present embodiment. The MPU (1001) executes a control program stored in a program ROM (1002) to perform control described below.

The MPU (1001) controllably allows a host interface (1006) to receive the control command output by the PC control device (0502). If the received control command is the format command (0901), the MPU (1001) saves various parameters to a work RAM (1005) and determines the sizes of the above-described two print buffers (1101 and 1102), which are present on the video RAM (1004), on the basis of the parameters for the print sizes X and Y in the format command (0901).

If the received control command is the text data command (0903), the MPU (1001) reads font data matching a text code in the text data section, from a CG-ROM (1003). The MPU (1001) then expands the font data read in accordance with attribute parameters in the text data command, into the data print buffer (1101 or 1102) on the video RAM (1004) in accordance with the print reference position specification (0908). If the received control command is the image data command (0904), the MPU (1001) expands image data read in accordance with parameters in an image data attribute section, into the print buffer (1101 or 1102) on the video RAM (1004) in accordance with the print reference position specification (0908).

If the received control command is the print start command (0906), the MPU (1001) starts a printing operation process. That is, the MPU (1001) drives a conveying motor driver (1013), a sheet feeding driver (1021), and a pump motor driver (1015) to drive the conveying motor (0811), the sheet feeding motor (0819), and the pump motor (0817). Furthermore, the MPU (1001) monitors signals output by the position detecting sensor (0807) via an I/O port (1020) to detect positional information on the leading and trailing ends of the print medium. When the print medium reaches a print position, the MPU (1001) controls a head driving circuit (1008) on the basis of the print data in the print buffer so that the print head (0805) can start an ink ejecting operation. Thus, printing of the print medium is started. Furthermore, on the basis of the condition of the printing apparatus, the MPU (1001) controllably turns on and off panel LEDs 1 and 2 (1018 and 1019) via the I/O port (1020) to display the condition of the printing apparatus.

Figure 12:
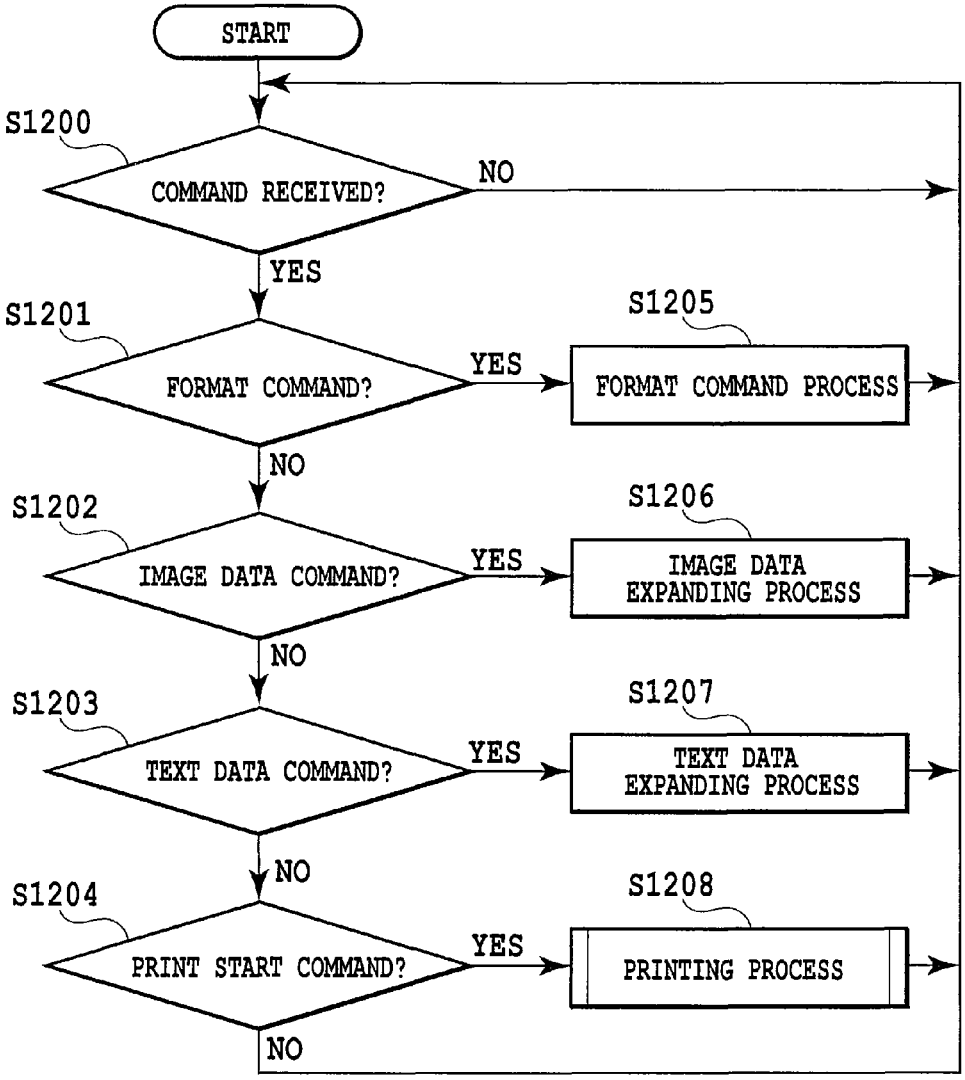
FIG. 12 is a flowchart showing the procedure of a main process executed by the ink jet printing apparatus according to the first embodiment.

FIG. 12 shows a flowchart of a main process in the printing apparatus according to the present embodiment. The MPU (1001) in the printing apparatus executes a control program stored in the program ROM (1002) to execute the process described below. First, when the printing apparatus is powered on, the MPU (1001) executes an initializing process and subsequently waits to receive a command from the PC control device (0502) (S1200). Upon receiving a command (YES in S1200), the MPU (1001) analyzes a command identification code. If the received command is the format command (0901) (the determination result in s1201 is YES), the MPU (1001) executes a format command process (S1205). If the received command is the image data command (0904) (the determination result in S1202 is YES), the MPU (1001) executes an image data expanding process (S1206). If the received command is the text data command (0903) (the determination result in S1203 is YES), the MPU (1001) executes a text data expanding process (S1207). If the received command is the print start command (0906) (the determination result in S1204 is YES), the MPU (1001) executes a printing process (S1208).

In the format command process (S1205), the MPU (1001) saves the parameters for the print sizes X and Y and a print medium count contained in the format command (901), in areas "A (print size X), B (print size Y), and C (print medium count)" on the work RAM (1005). The MPU (1001) calculates and determines the size of the print buffer (1101 or 1102) on the basis of the parameters for the print sizes X and Y.

In the image data expanding process (S1206), the MPU (1001) expands the image data in the data section (0905) into the print buffer specified in the print reference position specification (0908), in accordance with the parameters in the attribute section.

In the text data expanding process (S1207), the MPU (1001) expands the image data in the data section (0905) into the print buffer (1101 or 1102) specified in the print reference position specification (0908), on the basis of the parameters in the attribute section. In the printing process (S1208), the MPU (1001) performs a printing operation based on the data expanded into the print buffer (1101 or 1102), for the print medium count saved in the area C (print medium count).

Figure 13:
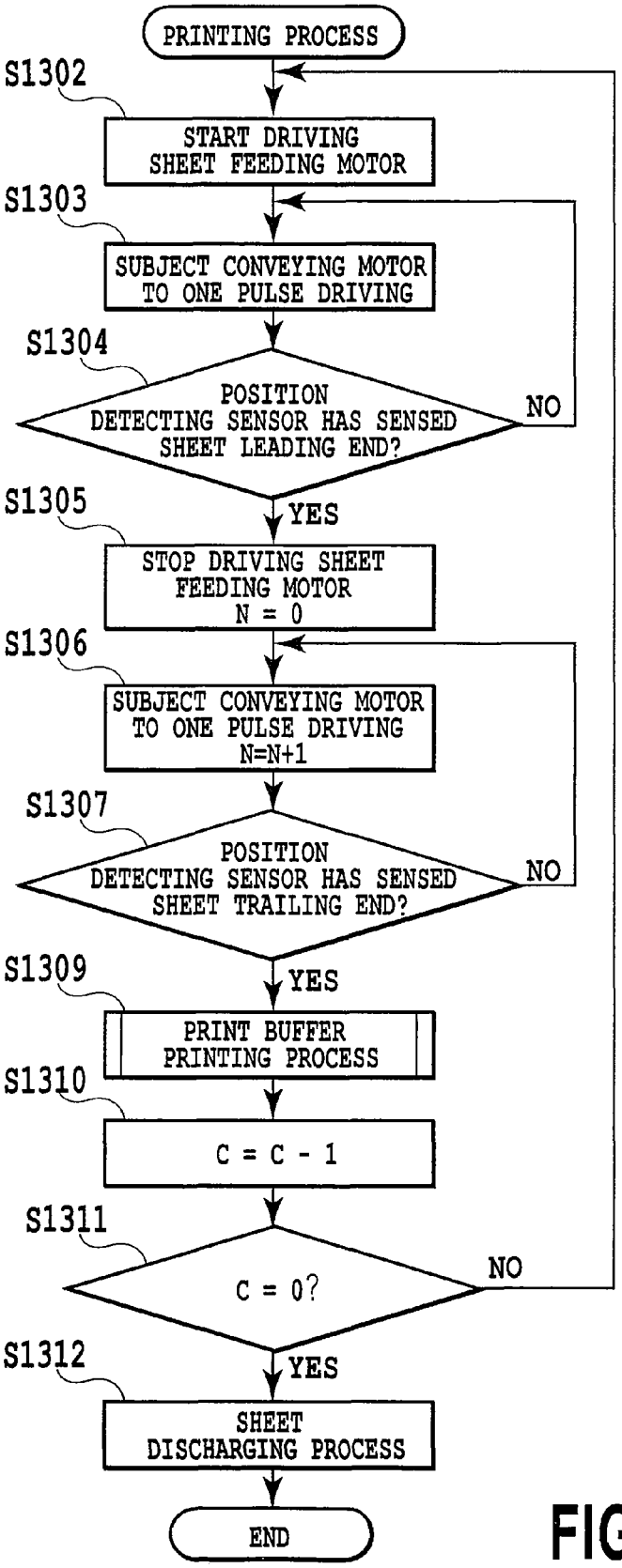
FIG. 13 is a flowchart showing the procedure of a printing process executed by the ink jet printing apparatus according to the first embodiment.

FIG. 13 shows a flowchart of the printing process in the printing apparatus according to the present embodiment. The MPU (1001) in the printing apparatus executes a control program stored in the program ROM (1002) to execute the process described below. First, the MPU (1001) starts driving the sheet feeding motor (S1302) to allow the sheet feeding section to start feeding print media. Then, the printing section subjects the conveying motor to one pulse driving (S1303), while determining whether or not the position detecting sensor (0807) has detected the leading end of the print medium (S1304). When the position detecting sensor detects the leading end (the determination result in S1304 is YES), the MPU (1001) stops driving the sheet feeding motor, and saves 0 in an area N (print medium size counter) on the work RAM (1005) (S1305).

Moreover, the printing section (0801) performs one-pulse driving of the conveying motor (0811) and incrementation of N (incrementation of the count in the print medium size counter) (S1306), while determines whether or not the position detecting sensor (0807) has detected the trailing end of the print medium (S1307). When the trailing end of the print medium is detected by the position detecting sensor (the determination result in S1307 is YES), the value N (print medium size counter) indicates the size of the print medium.

When the trailing end of the print medium is detected by the position detecting sensor (the determination result in S1307 is YES), the printing section executes a print buffer printing process (51309) to perform a printing operation on the fed print medium on the basis of the data stored in the print buffer. The printing section further decrements the value C (print medium count) (S1310). If the value C (print medium count) is not 0 (the determination result in S1311 is NO), the printing section starts driving the sheet feeding motor (0819) (S1302) to allow the sheet feeding section (0814) to feed the next print medium to the printing section (0801). If the value C (print medium count) is 0 (the determination result in S1311 is YES), the printing section discharges the print medium to complete the printing process.

Figure 14:
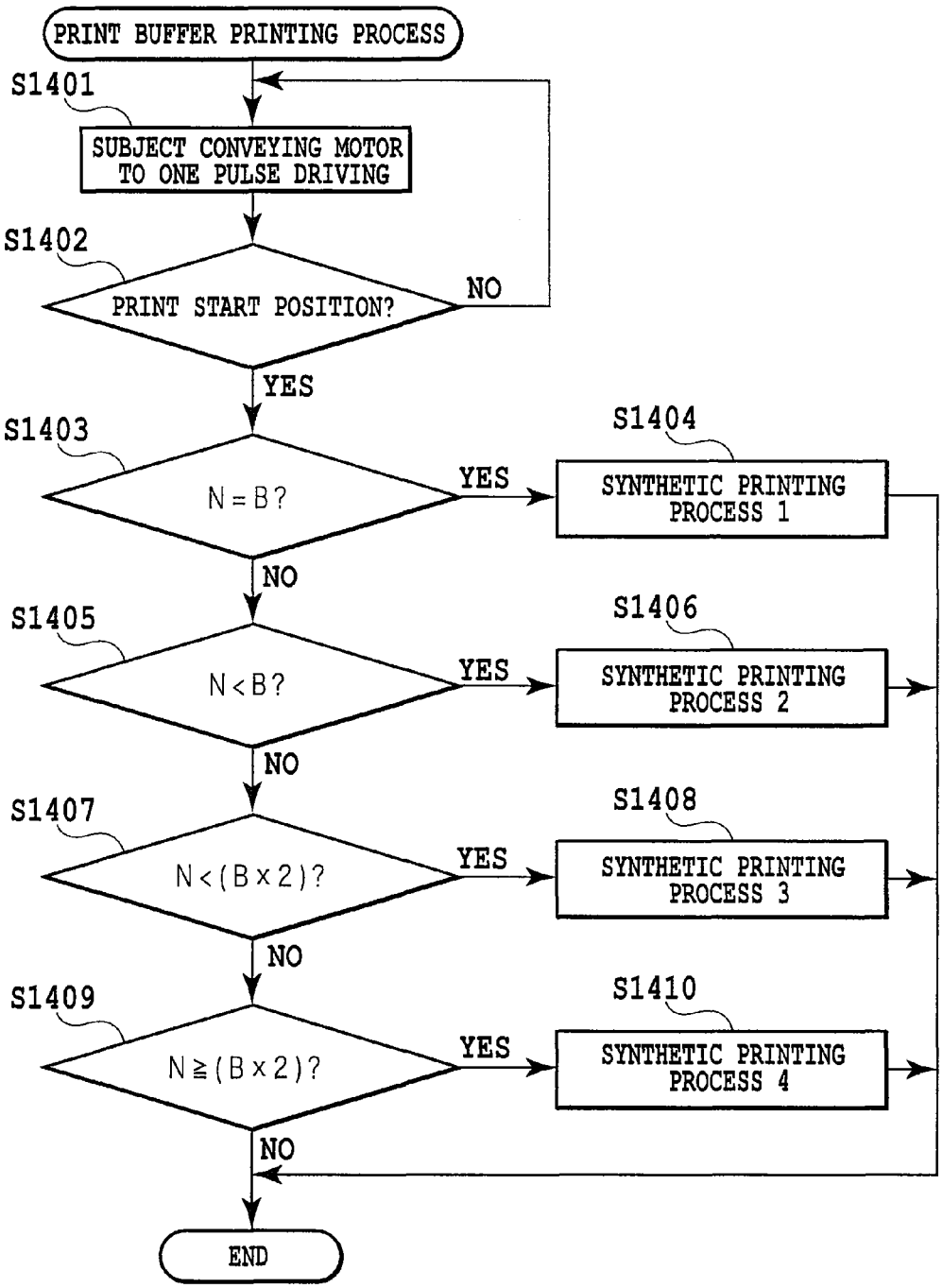
FIG. 14 is a flowchart showing the procedure of a print buffer printing process executed by the ink jet printing apparatus according to the first embodiment.

FIG. 14 shows a flowchart of the print buffer printing process in the printing apparatus according to the present embodiment.

The MPU (1001) in the printing apparatus executes a control program stored in the program ROM (1002) to execute the process described below. First, the printing section subjects the conveying motor to one pulse driving (S1401), while determining whether or not the leading end of the print medium reached the position of the print head (0805), which is the print start position (S1402). When the leading end of the print medium reaches the print start position (YES in S1402), an optimum synthetic printing process described below is executed on the basis of the relationship between the value N (print medium size counter) and the value B (print medium size Y). In the present embodiment, margins formed at the leading and trailing ends of the print medium are not taken into account, and it is assumed that "print medium size=printable size".

Figure 15A:
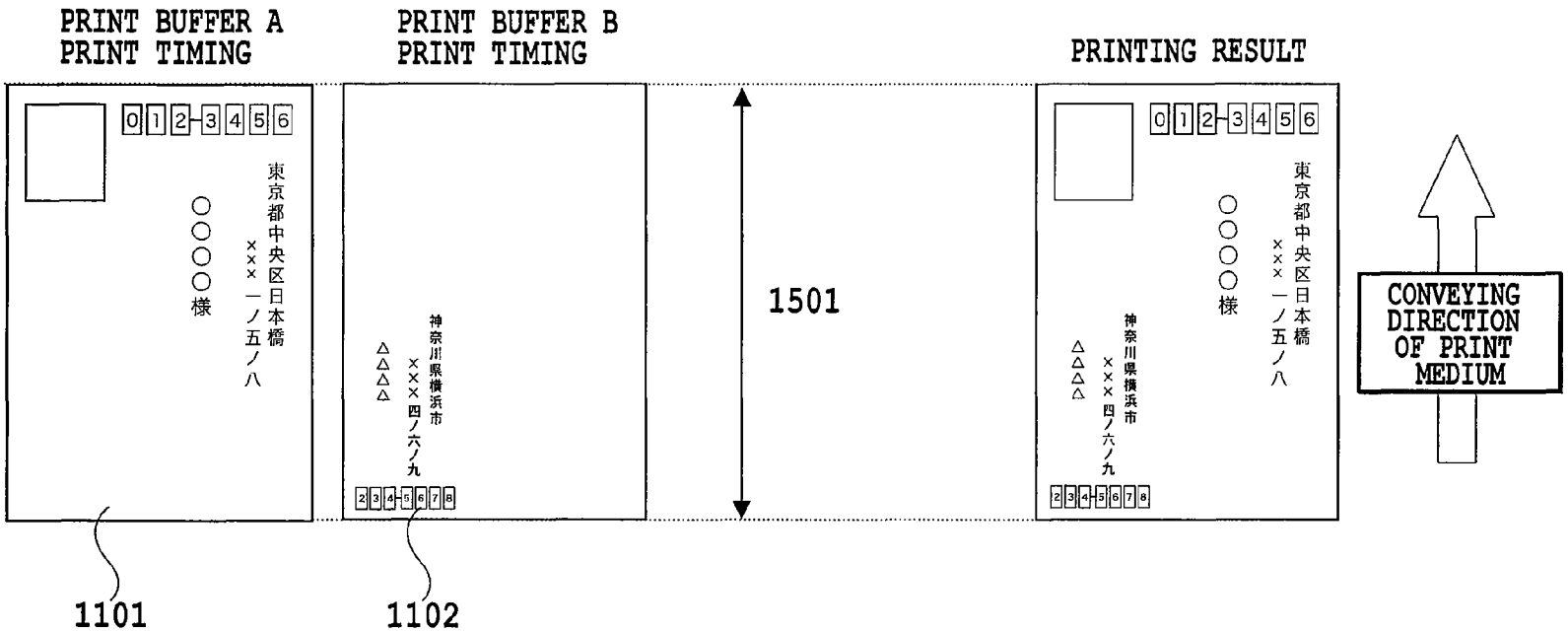
FIGS. 15A to 15D are diagrams illustrating the results of printing of postcards of various print medium lengths by the printing apparatus to which the first embodiment is applied.

A synthetic printing process 1 (S1404) is executed if the value N (print medium size counter) is the same as the value B (print medium size Y) (the determination result in S1403 is YES). In this case, a printing operation timing based on the print data in the print buffer A (1101) is the same as that based on the print data in the print buffer B (1102) (see FIG. 15A).

In this case, since print areas of the two print buffers (1101 and 1102) overlap entirely, the logical OR of amounts B (print size Y) (1501) of the print buffers (1101 and 1102) is calculated. The data for which the logical OR is calculated is printed.

Figure 15B:
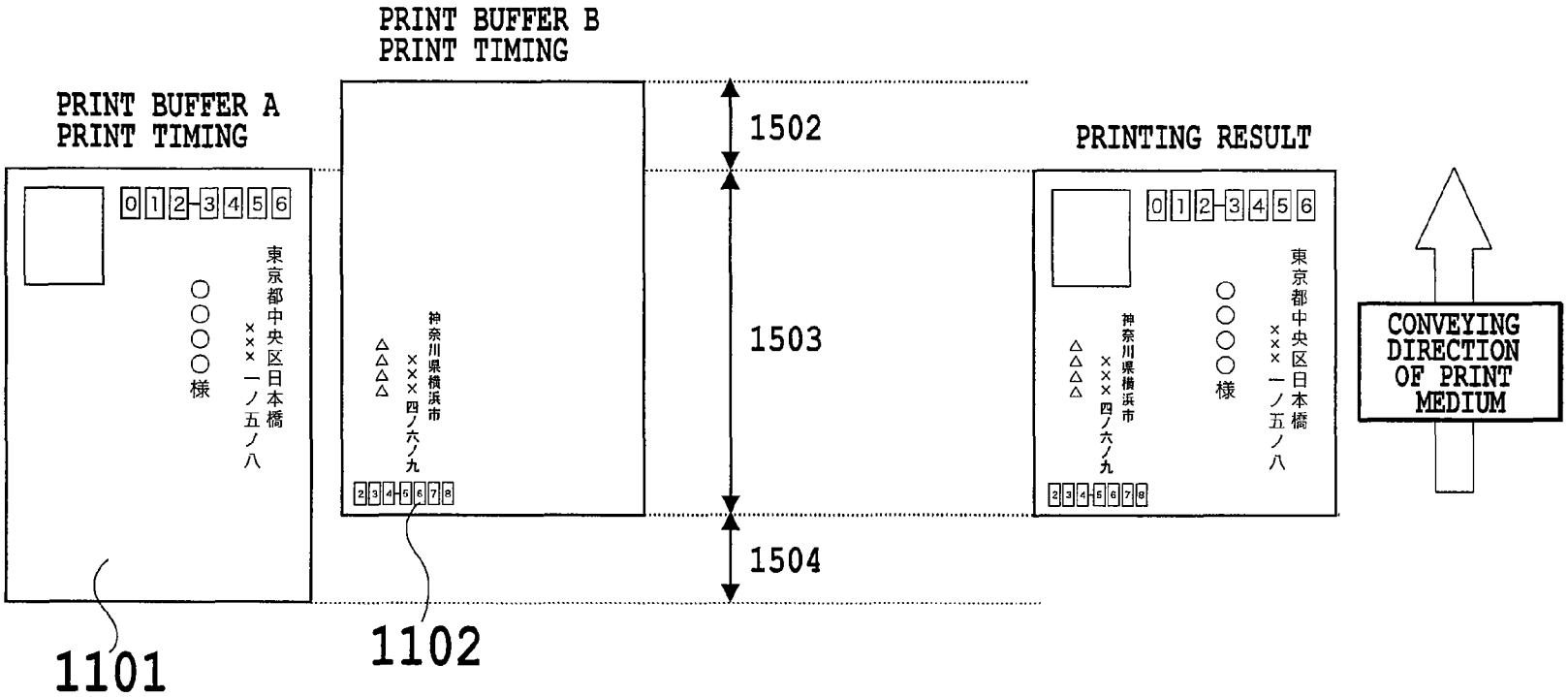

A synthetic printing process 2 (S1406) is executed if the value N (print medium size counter) is smaller than the value B (print size Y) (the determination result in S1405 is YES). In the synthetic printing process 2, the print start timing for the print buffer B (1102) is faster than that for the print buffer A (1101) (see FIG. 15B). In this case, printing is not performed for a leading end portion (1502) of the print buffer B (1102). For an area (1503) in which the two print buffers overlap, the logical OR of the data in the two buffers (1101 and 1102) is calculated, and the data for which the logical OR is calculated is printed. A trailing end portion (1504) of the print buffer A (1101) is not printed.

Figure 15C:
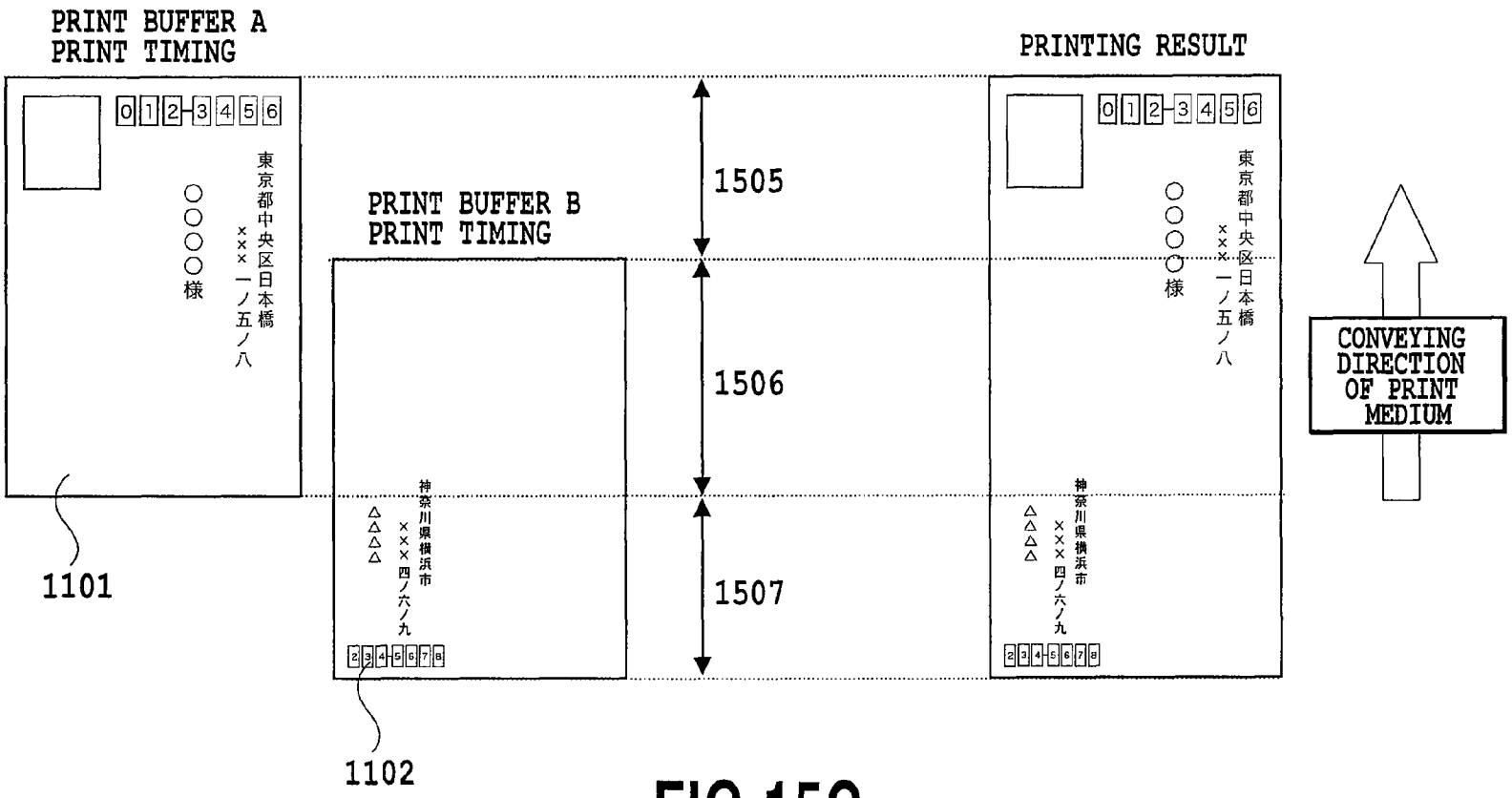

A synthetic printing process 3 (S1408) is executed if the value N (print medium size counter) is larger than the value B (print size Y) and smaller than the double of the value B (print size Y) (the determination result in S1407 is YES). In the synthetic printing process 3, the print start timing for the print buffer A (1101) is faster than that for the print buffer B (1102), and the two print buffers have different print areas (see FIG. 15C). For a leading end portion (1505) of the print medium, the data in the print buffer A (1101) is printed. For an area (1506) in which the two print buffers overlap entirely, the logical OR of the data in the two buffers (1101 and 1102) is calculated, and the data for which the logical OR is calculated is printed. A trailing end portion (1507) of the print area is printed on the basis of the data in the print buffer B (1102).

Figure 15D:
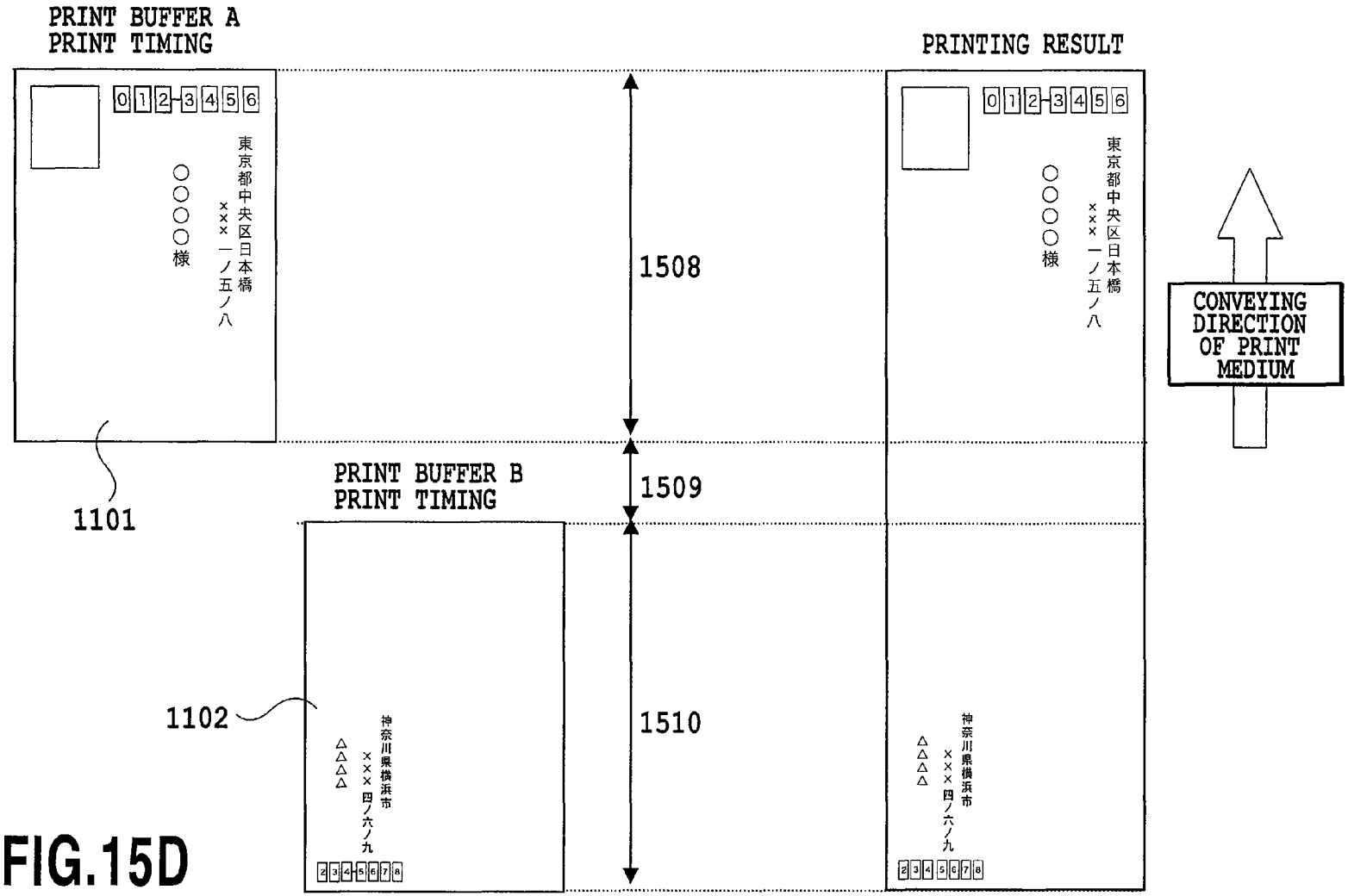

A synthetic printing process 4 (S1410) is executed if the value N (print medium size counter) is at least double the value B (print size Y) (the determination result in S1409 is YES). In the synthetic printing process 4, the print start timing for the print buffer A (1101) is faster than that for the print buffer B (1102), and the print areas of the two print buffers do not overlap (see FIG. 15D). Consequently, a leading end portion (1508) of the print medium is printed on the data in the print buffer B (1101). An area (1509) in which the two print buffers (1101 and 1102) do not overlap is not printed. A trailing end portion (1510) of the print area is printed on the basis of the data in the print buffer B (1102).

As described above, according to the first embodiment, the image to be formed on the print medium can be printed in a well-balanced layout appropriate for the size of the print medium. The quality of printing results can thus be improved.

Second Embodiment

Figure 16A:
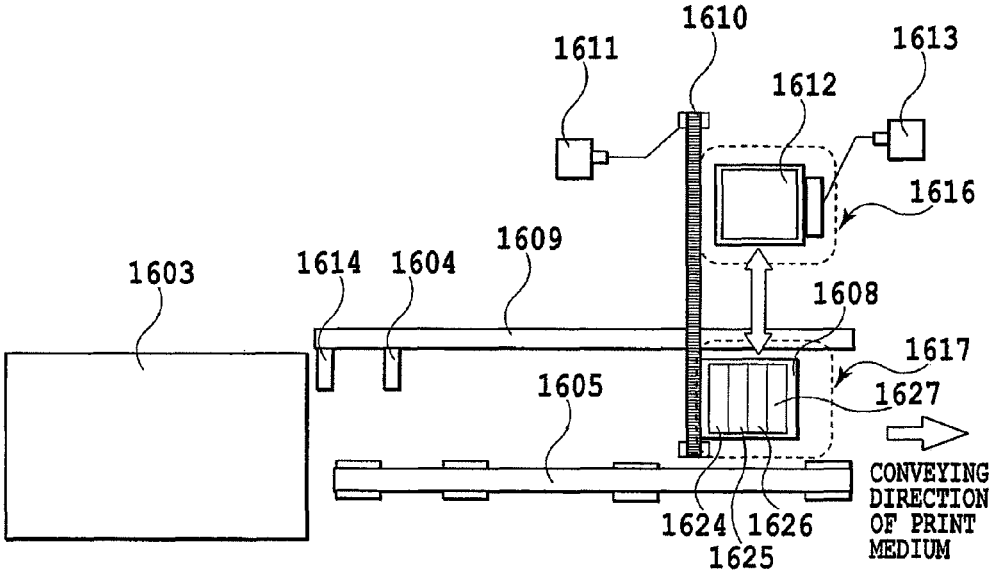
FIG. 16A is a plan view showing a general configuration of an ink jet printing apparatus according to the second embodiment.
Figure 16B:
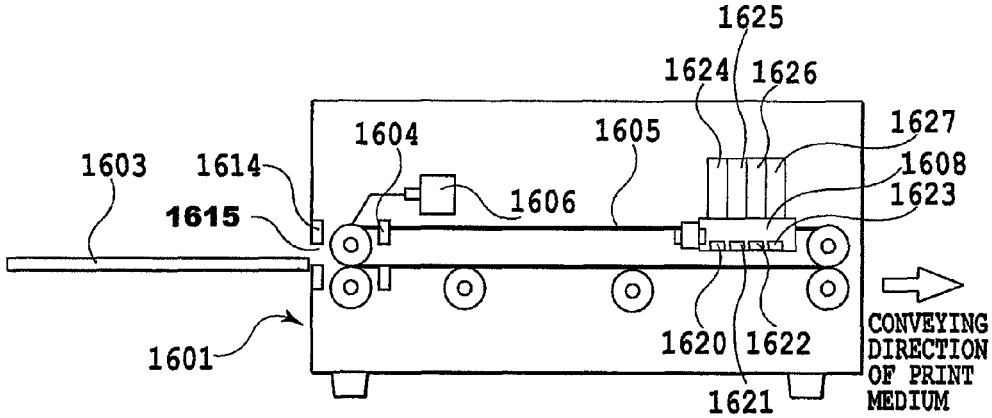
FIG. 16B is a vertically sectional side view showing the general configuration of the ink jet printing apparatus according to the second embodiment.

FIGS. 16A and 16B are a plan view and a horizontally sectional view of a general configuration of a postpaid postage mark printing apparatus (hereinafter referred to as a "printing apparatus") using a line print head (hereinafter referred to as a "print head") based on an ink jet method.

A print head unit (1608) of the printing apparatus (1601) includes print heads (1620, 1621, 1622, and 1623) for black, cyan, magenta, and yellow having nozzles arranged in a direction orthogonal to a direction in which envelopes are conveyed, to print color data, the nozzles corresponding to a print width, and replaceable ink tanks (1624, 1625, 1626, and 1627) for black, cyan, magenta, and yellow from which ink is fed to the print heads. The print head unit (1608) can be moved between a print position (1617) and a maintenance position (1616) via a carriage belt (1610) driven by a carriage motor (1611). At the print position (1617), an envelope (print medium) being conveyed can be printed. At the maintenance position (1616), the print head is subjected to maintenance such as cleaning or protection by a maintenance unit (1612) driven by a maintenance motor (1613).

A sheet feeding method used in the second embodiment is manual feeding. Thus, the apparatus has an insertion detecting sensor (1614) that detects that the user has inserted an envelope (1603) into a sheet feeding port (1615). When the insertion detecting sensor (1614) detects that the user has inserted the envelope into the sheet feeding port (1615), the print head unit (1608) moves to a print position (1617). Then, the conveying motor (1606) starts driving the conveying belt (1605), which thus moves to convey the envelope (1603) along a reference wall (1609). When the position detecting sensor (1604) detects the leading or trailing end of the envelope being conveyed, the print heads (1620, 1621, 1622, and 1623) are driven in accordance with the print data on the basis of the detected positional information. The print heads (1620, 1621, 1622, and 1623) thus eject the ink to form an image.

Figure 17A:
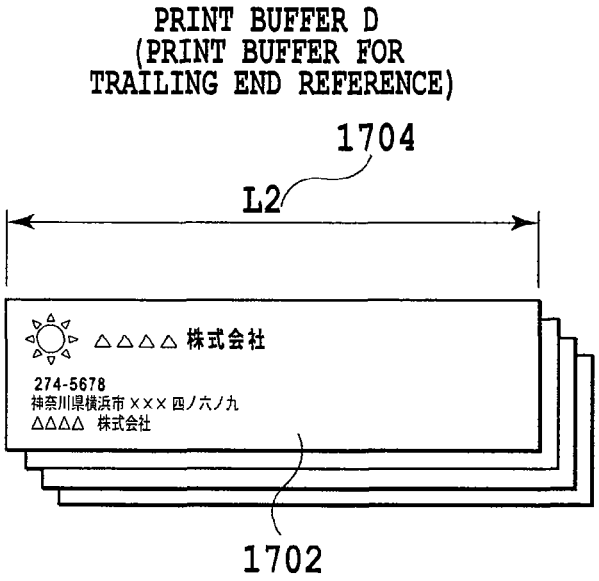
FIG. 17A is a diagram conceptually showing print data stored in a print buffer A in the ink jet printing apparatus according to the second embodiment, the print buffer A storing leading end-based data.
Figure 17B:
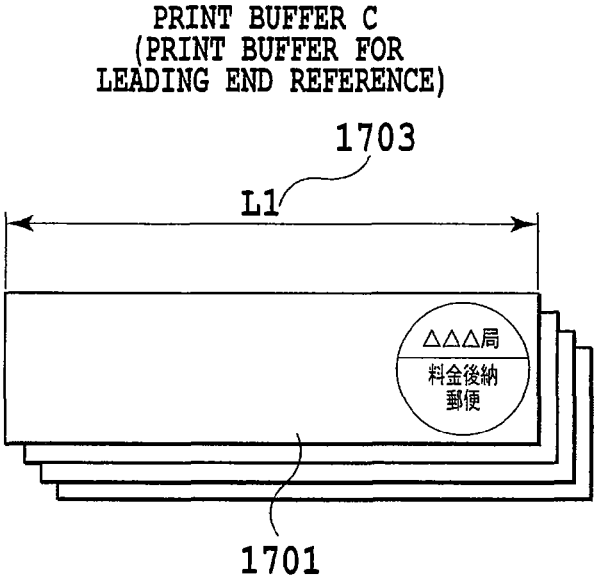
FIG. 17B is a diagram conceptually showing print data stored in a print buffer B in the ink jet printing apparatus according to the second embodiment, the print buffer A storing trailing end-based data.

FIGS. 17A and 17B show the structure of a print buffer used in the present embodiment. Image data on a postpaid postage is expanded into a print buffer C (1701) used for leading end reference printing. Image data on a sender (company address, company name, and logo mark) is expanded into a print buffer D (1702) used for trailing end reference printing. Each of the two print buffers is made up of four layers for black, cyan, magenta, and yellow for color printing. The layers are located on a video RAM (1904) shown in FIG. 19. The size of the print buffers is fixed. Additionally, the print length of the print buffer C on an envelope (1701) is fixed to L1 (1703). The print length of the print buffer D on the envelope (1702) is fixed to L2 (1704).

Figure 18A:
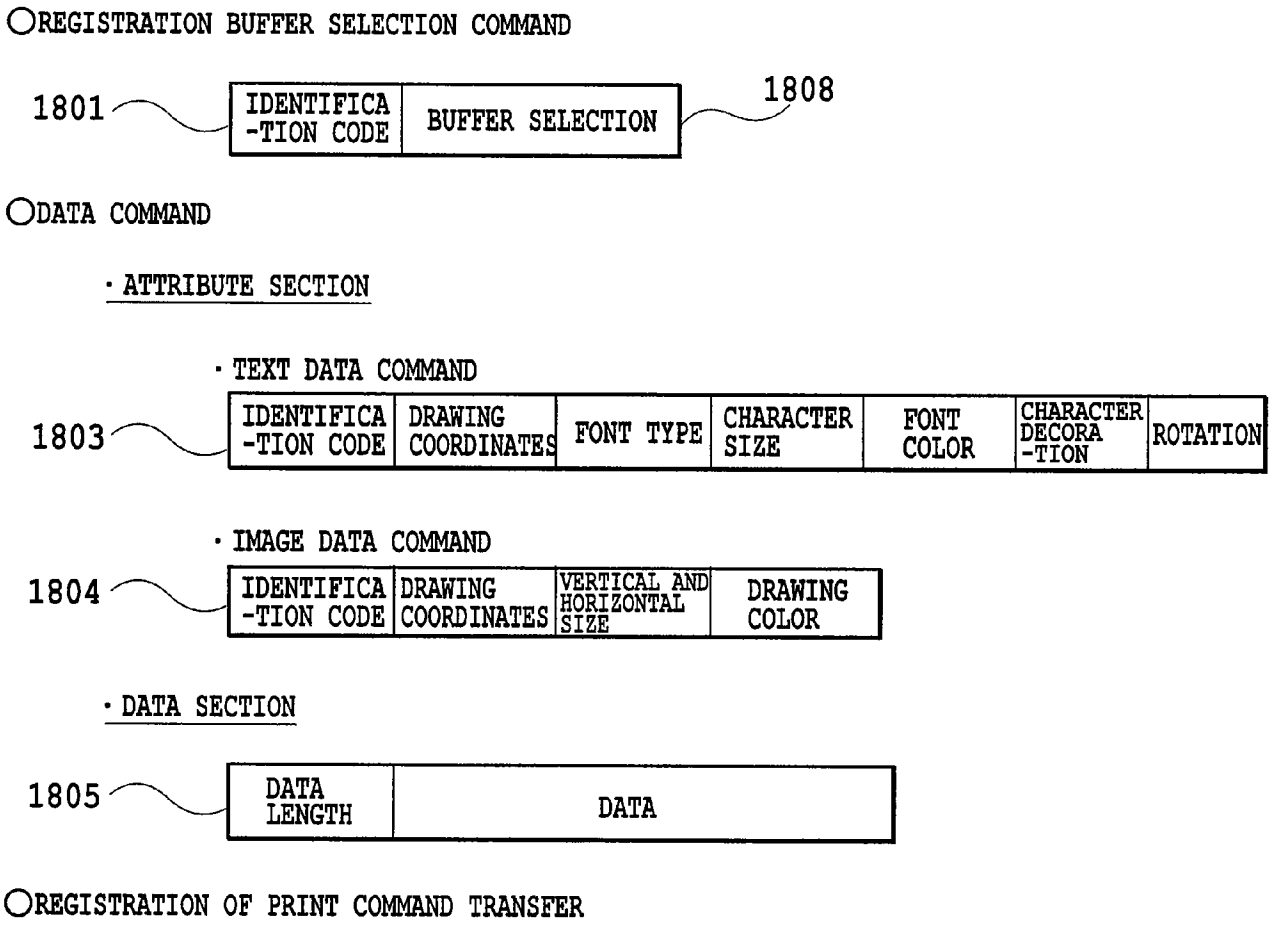
FIG. 18A is a diagram illustrating a control command system used in the ink jet printing apparatus according to the second embodiment.

FIG. 18A shows the structure of control commands used in the present embodiment. The control commands are intended to register print data in the printing apparatus (1601). A buffer selection parameter (1808) in a registration buffer selection command (1801) allows selection of which of the print buffers C (1701) and D (1702) the print data is to be registered.

Data commands include a text data command (1803) containing various attributes of text, an image data command (1804) containing various attributes of image data, a data section (1805) made up of data such as text and image data, and a registration start command (1806) which indicates the end of registration data and which starts registration in a program ROM (1902: see FIG. 19) that is a rewritable nonvolatile memory (for example, a flash ROM).

Figure 18B:
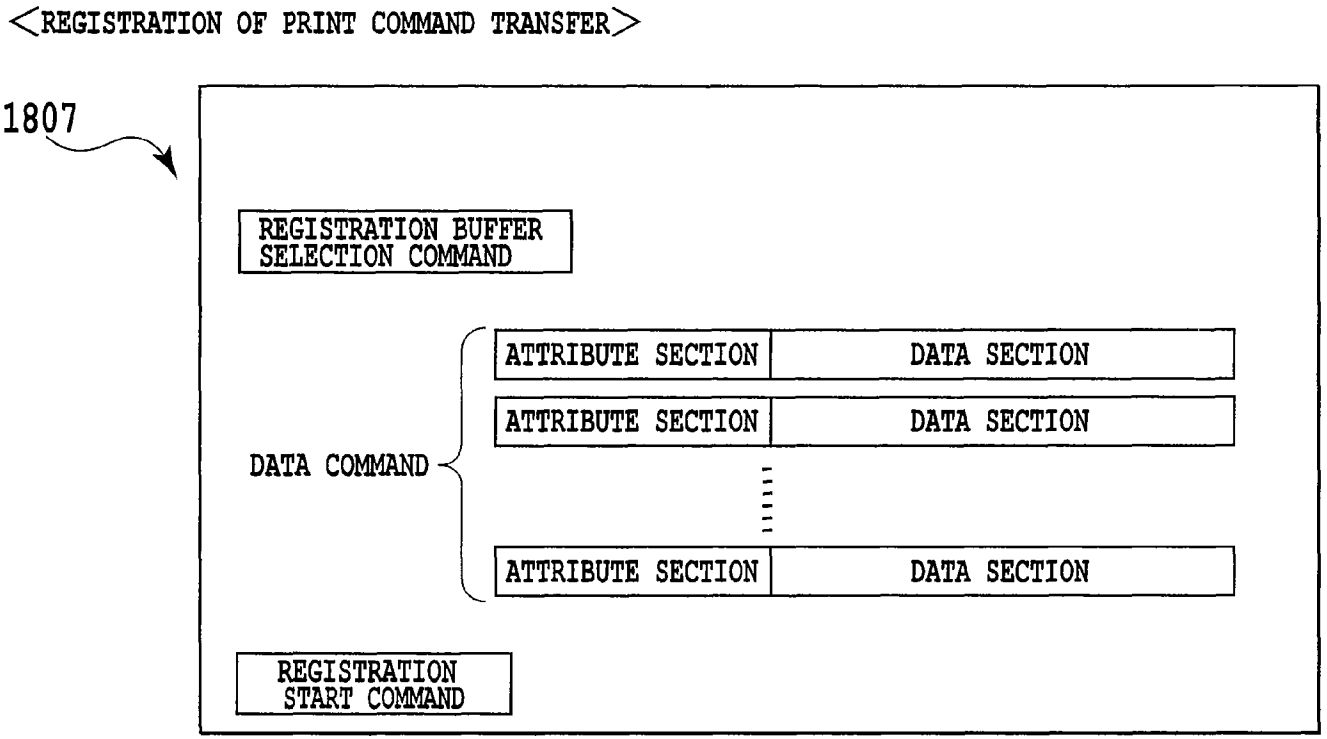
FIG. 18B is a diagram showing an example of transfer of print commands used in the ink jet printing apparatus according to the second embodiment.

These control commands are output by a host computer as in the case of an example of transfer (1807) shown in FIG. 18B. In the present embodiment, the buffer selection parameter (1808) of "0" indicates the selection of the print buffer C (1701). The buffer selection parameter (1808) of "1" indicates the selection of the print buffer D (1702).

Figure 19:
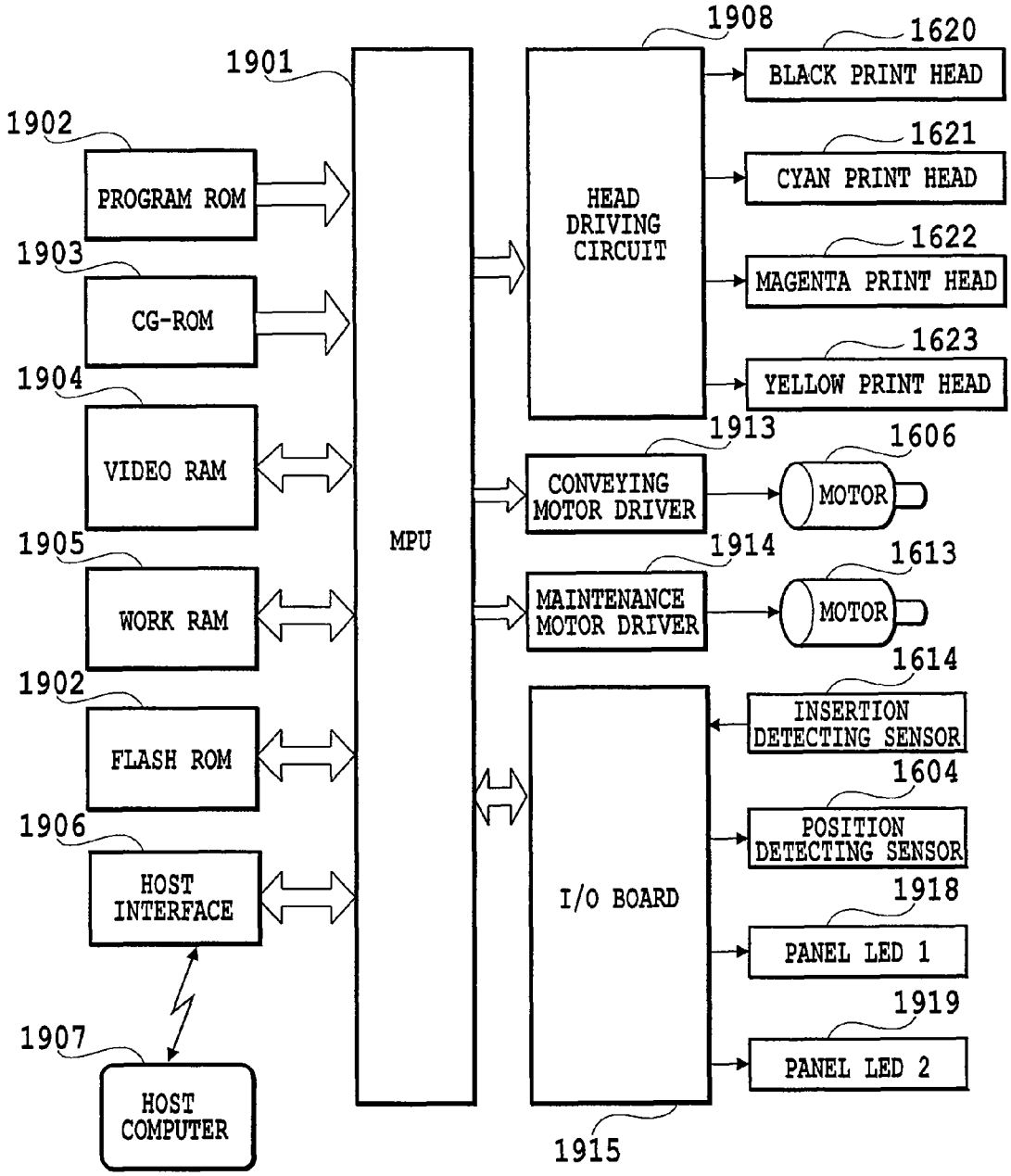
FIG. 19 is a block diagram showing a control system in the ink jet printing apparatus according to the second embodiment.

FIG. 19 shows a block diagram of a control system in the printing apparatus (1601) according to the present embodiment. An MPU (1901) executes a control program stored in the program ROM (1902) to perform control described below.

The MPU (1901) controllably allows a host interface (1906) to receive the various control commands output by the host computer (1907). If the received control command is the registration buffer selection command (1801), the buffer selection parameter (1808) is saved in an area "P" on a work RAM (1905). If the received control command is the text data command (1803), font data matching a text code in the text data section is read from a CG-ROM (1903). The font data read in accordance with the attribute parameters in the text data command is expanded into the print buffer specified by the parameter P (buffer selection parameter).

If the received control command is the image data command, the image data is expanded into the print buffer specified by the parameter P (buffer selection parameter), in accordance with the attribute parameters in the image data command. If the received control command is the registration start command (1806), the data in the print buffer specified by the parameter P (buffer selection parameter) is registered in the program ROM (1902), which is a rewritable nonvolatile memory.

Furthermore, the MPU (1901) controllably allows a conveying motor driver (1913) and a maintenance motor driver (1914) to drive the conveying motor (1606) and the maintenance motor (1613). The MPU (1901) monitors signals output by the insertion detecting sensor (1614) and the position detecting sensor (1604) via the I/O port (1915) to detect insertion of an envelope into the sheet feeding port, and positional information on the trailing and leading end of the envelope being conveyed. Moreover, at a timing for starting a printing operation, the MPU (1901) controls a head driving circuit (1908) on the basis of the print data stored in the print buffer. Thus, the print heads (1620, 1621, 1622, and 1623) provided in the print head unit (1608) ejects ink to print the envelope. Depending on the condition of the printing apparatus, the MPU (1901) controllably turns on and off panel LEDs 1 (1918) and 2 (1919) via the IO port (1915) to display the condition of the printing apparatus.

Figure 20:
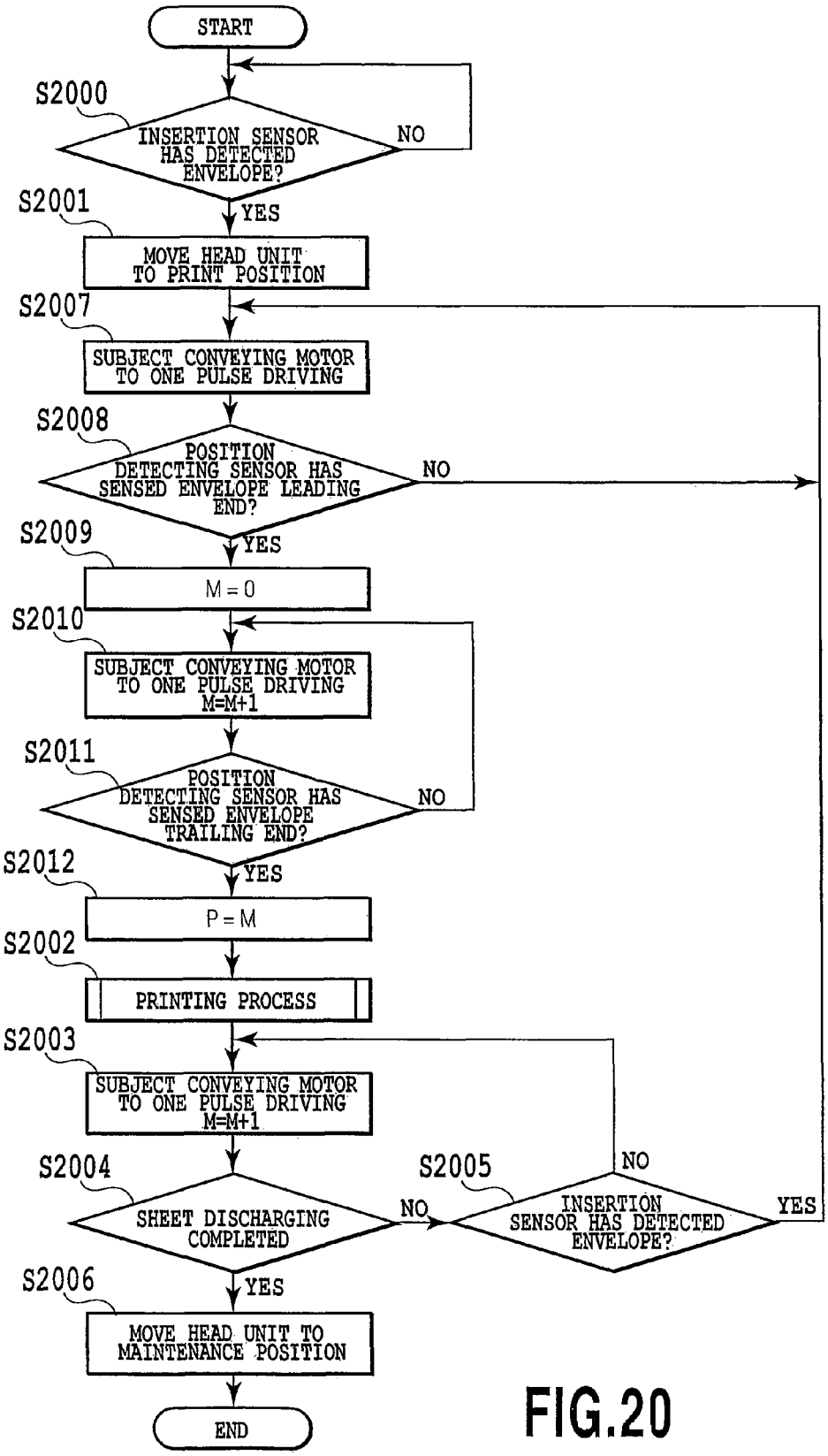
FIG. 20 is a flowchart showing the procedure of a main process executed by the ink jet printing apparatus according to the second embodiment.

FIG. 20 shows a flow chart of a main process in the printing apparatus according to the present embodiment. The MPU (1901) in the printing apparatus executes a control program stored in the program ROM (1902) to execute a process described below. In the present embodiment, with, for example, print margins at the leading and trailing ends not taken into account, the "print medium size=printable size". When the printing apparatus is powered on, the MPU (1901) executes the initializing process and copies the registered data stored in the program ROM (1902) and corresponding to the print buffers C (1701) and D (1702) in the video RAM (1904), to the print buffers C (1701) and D (1702). Then, the MPU (1901) waits for the insertion detecting sensor (1614), located at the sheet feeding port (1615), to detect the envelope (S2000). When the insertion detecting sensor (1614) detects the envelope (the determination result in S2000 is YES), the MPU (1901) moves the head unit (1608) to the print position (1617) (S2001).

Then, the MPU (1901) subjects the conveying motor to one pulse driving (S2007), while determining whether or not the position detecting sensor (1604) has detected the leading end of the print medium (S2008). When the position detecting sensor detects the leading end of the envelope (the determination result in S2008 is YES), the MPU (1901) saves 0 in an area M (envelope position counter) on the work RAM (1905) which counts the size of the envelope in the conveying direction (S2009).

Moreover, while subjecting the conveying motor (1606) to one pulse driving and incrementing M (the count in the envelope position counter) (S2010), the MPU (1901) determines whether or not the position detecting sensor (1604) has detected the trailing end of the envelope (S2011). When the position detecting sensor (1604) detects the trailing end of the envelope (the determination result in S2011 is YES), M (the count in the envelope position counter) indicates the size of the envelope. The MPU (1901) saves M (the count in the envelope position counter) in an area P (envelope size) on the work RAM (1905) (S2012). Then, the MPU (1901) carries out a print buffer printing process (2002) to perform a printing operation on the supplied envelope on the basis of the data stored in the print buffers.

When the printing process (S2002) is completed, the MPU (1901) drives the conveying motor 1 at one pulse increments (S2003) and increments M (the count in the envelope position counter), while waiting for a sheet discharging operation to complete (S2004). During sheet discharging (the determination result in S2004 is NO), when the insertion detecting sensor detects the envelope (the determination result in S2005 is YES), the MPU (1901) conveys the detected next envelope for printing. When the sheet discharging is completed with the next envelope failing to be detected (the determination result in S2004 is YES), the MPU (1901) moves the print head unit (1608) to the maintenance position (1616) to protect the print heads (S2006).

Figure 21A:
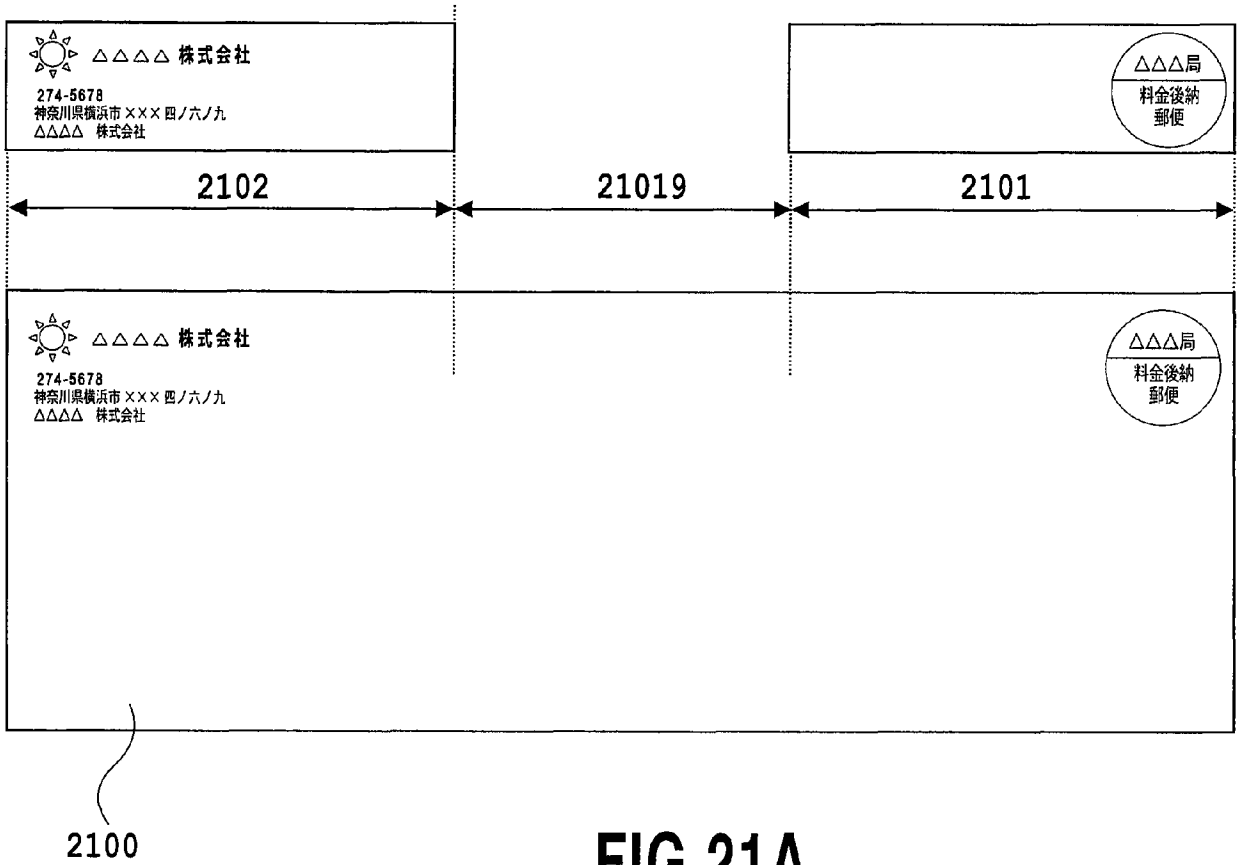
FIGS. 21A and 21B are diagrams showing the results of printing of envelopes of various print medium lengths by the ink jet printing apparatus according to the second embodiment.
Figure 21B:
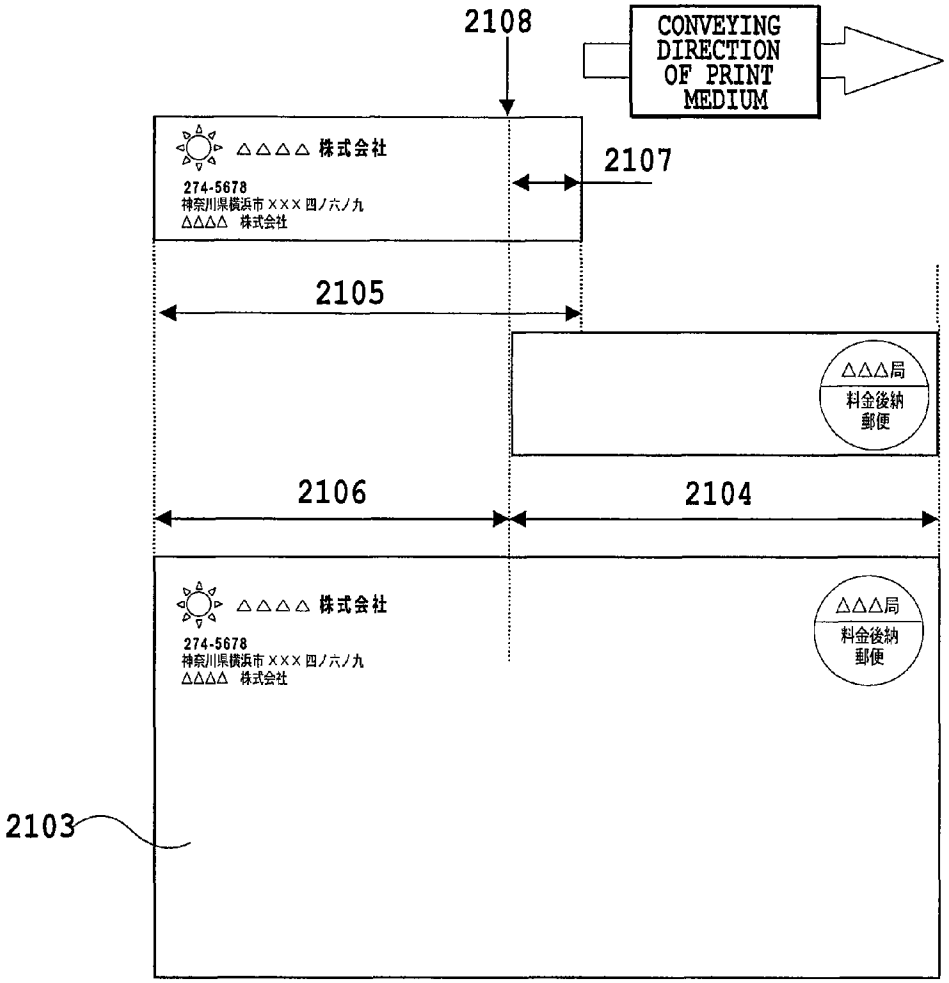

FIGS. 21A and 21B show an example of the results of printing by the printing apparatus according to the present embodiment. FIG. 21A shows a printing result (2100) obtained when a print area (2101) of the print buffer C does not overlap a print area (2102) of the print buffer D. In this case, the print area (2101) of the print buffer C is printed, and the envelope is then conveyed by a predetermined distance (2109). The print area (2102) of the print buffer D is subsequently printed. FIG. 21B shows a printing result obtained when a print area (2104) in the print buffer C and a print area (2105) of the buffer D partly overlap (2107). In FIG. 21B, after printing of the print area (2104) of the print buffer C is completed, a print area (2106) of the print buffer D is printed which extends from the middle to end of the print buffer D.

Figure 22:
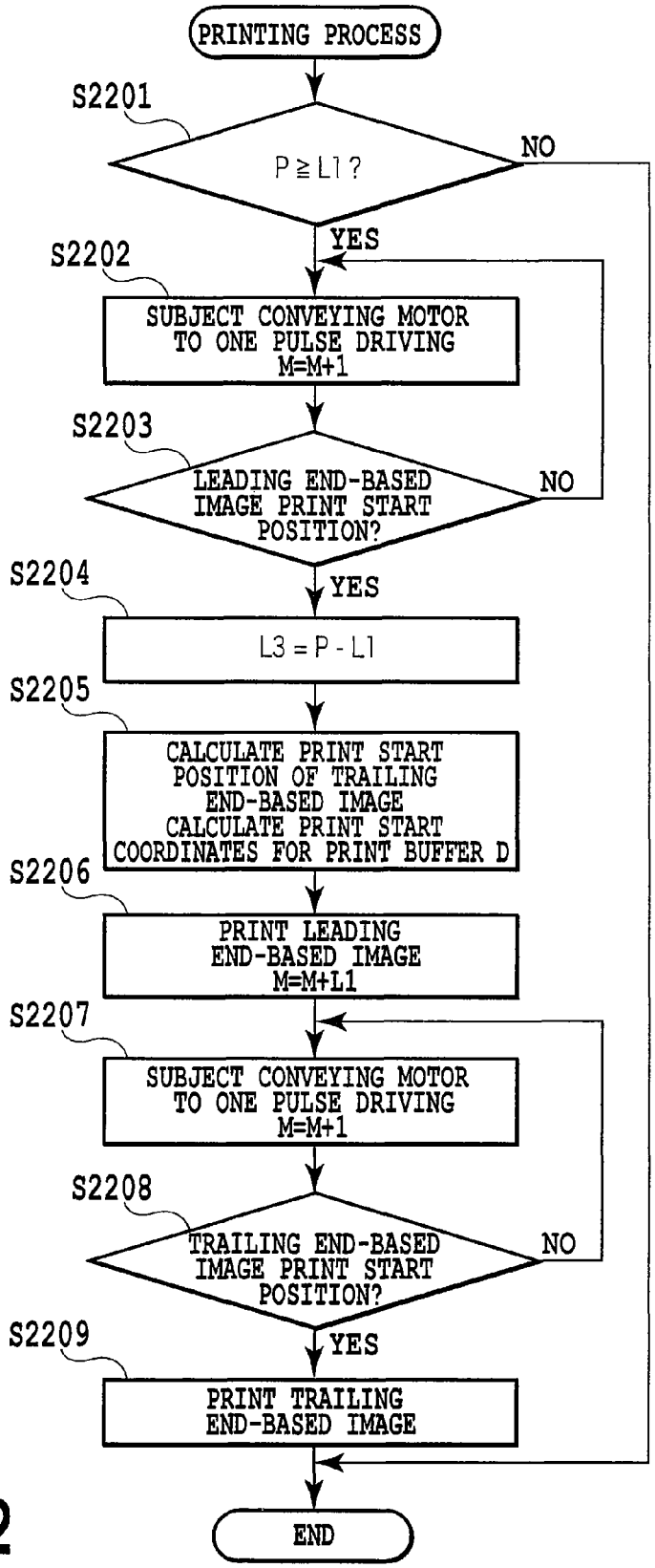
FIG. 22 is a flowchart showing the procedure of a printing process executed by the ink jet printing apparatus according to the second embodiment.

FIG. 22 shows a flowchart of a printing process in the printing apparatus according to the present embodiment. The MPU (1901) in the printing apparatus executes a control program stored in the program ROM (1902) to carry out a process described below.

First, if P (envelope size) is less than L1 (the print length of a leading end-based image) (the determination result in S2201 is NO), not the entire print area of image data on postpaid postage mark expanded in the print buffer C (1701) can be printed. Thus, the process is terminated.

Then, while subjecting the conveying motor to one pulse driving and incrementing M (the count in the envelope position counter) (S2202), the MPU (1901) determines whether or not the leading end of the envelope has reached the position of the black print head (1624), that is, the print start position (S2203). When the leading end of the envelope has reached the print start position of the black print head (1624) (the determination result in S2203 is YES), the MPU (1901) subtracts L1 (the print length of the leading end-based image) from P (envelope size) to calculate L3 (the printable size of a trailing end-based image) (S2204). Moreover, the MPO (1901) calculates the distance from the trailing end of the leading end-based image to the leading end of the trailing end-based image (the distance to the "print start position") as well as "print start coordinates" for the print buffer D (1701) (S2205). The "print start coordinates" for the print buffer D (1701) are obtained by setting the position of the head of the print buffer D (1701) to be 0. The "distance to the print start position" and the "print start coordinates" are calculated as shown below.

$$\text{"}P \geq L1+L2\text{"} \quad \text{(i)}$$

"Distance to the print start position (2109)"=P−L1−L2

Print start coordinates=0 (this means that the printing starts from the head of the print buffer D.)

$$\text{"}P < L1+L2\text{"} \quad \text{(ii)}$$

"Distance to the print start position"=0 (this means that printing starts immediately after an operation of printing the trailing end of the print buffer C)

Print start coordinates (2108)=P−L1

The MPU (1901) then prints the image on the envelope in accordance with the image data stored in the print buffer C (1701) as a leading end-based image. The MPU (1901) adds L1 (the print length of the leading end-based image) to M (the count in the envelope position counter) (2206).

Then, while subjecting the conveying motor to one pulse driving and incrementing M (the count in the envelope position counter) (S2207), the MPU (1901) conveys the envelope by the "distance to the print start position" calculated in the step (S2205), described above. Then (YES in S2208), the MPU (1901) starts printing the envelope from the "print start coordinates" for the print buffer D (1701) calculated in the step (S2205), described above. Print timing is shifted among the cyan, magenta, yellow print heads (1621, 1622, and 1623) by the distance between the adjacent heads.

As described above, the second embodiment also allows print media of various sizes to be printed so as to maintain a good balance between image portions based on the leading end and image portions based on the trailing end.

Third Embodiment

Now, a third embodiment of the present invention will be described. In the third embodiment, an impression printing apparatus (hereinafter referred to as a "printing apparatus") using a line print head based on the ink jet method will be described. The ink jet printing apparatus according to the third embodiment corresponds to the configuration shown in the second embodiment and in which a dedicated print head and a dedicated ink tank for special color ink are added in order to print an impression. Furthermore, the ink jet printing apparatus according to the third embodiment corresponds to the configuration shown in the second embodiment and additionally having an operation panel via which an "envelope size" and an "envelope weight" required to calculate the amount of the postage of an envelope with an impression printed thereon are input.

Figure 23:
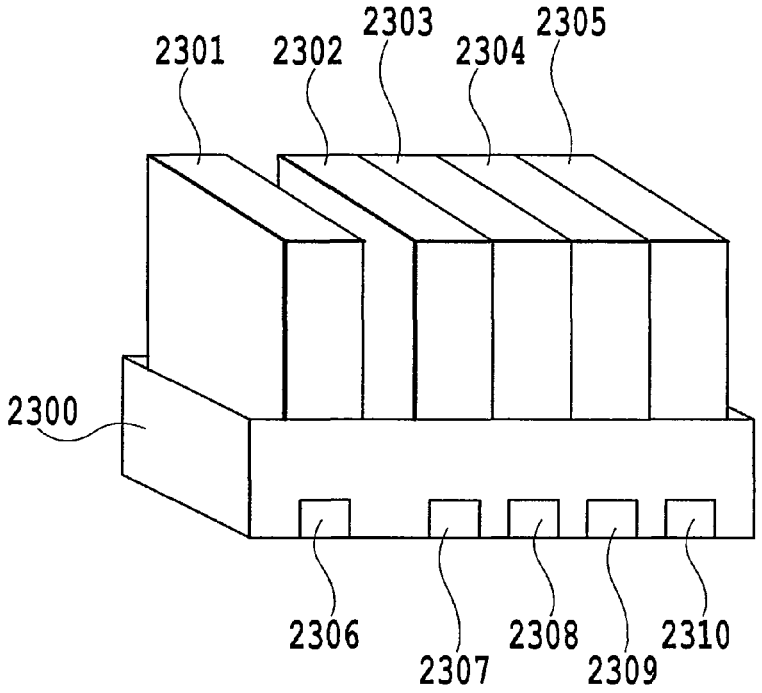
FIG. 23 is a perspective view of a print head unit in an ink jet printing apparatus according to a third embodiment.

FIG. 23 shows a schematic diagram of a print head unit (2300) used in the present embodiment. The print head unit (2300) includes print heads (2307, 2308, 2309, and 2310) for black, cyan, magenta, and yellow which are used to print color images, and a print head (2306) for special color printing which is used to print impressions. Replaceable ink tanks (2302, 2303, 2304, 2305, and 2306) for the supply of black ink, cyan ink, magenta ink, yellow, ink, and special color ink, respectively, are installed in the respective print heads.

Figure 24:
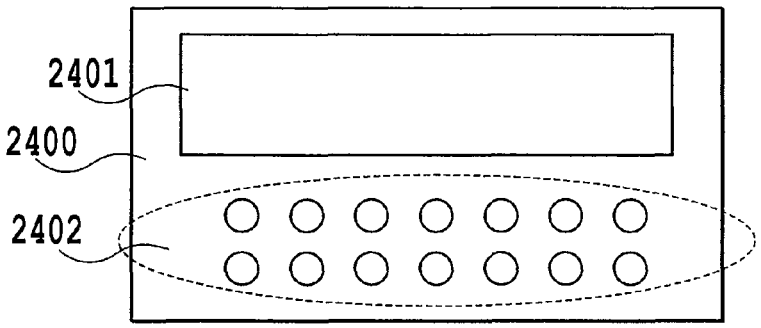
FIG. 24 is a schematic diagram of an operation panel used in the third embodiment.

FIG. 24 shows a schematic diagram of the operation panel used in the present embodiment. The operation panel (2400) comprises an LCD (2401) that displays various messages and the like and a plurality of keys (2402) serving as input means.

Figure 28:
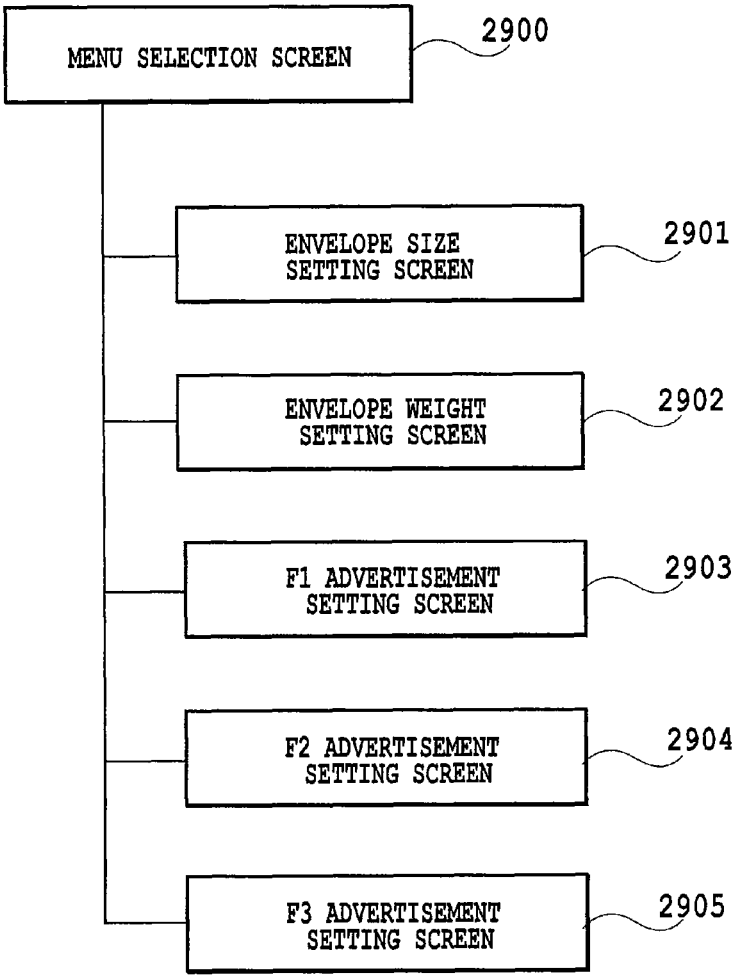
FIG. 28 is a diagram showing a part of a menu hierarchy for the operation panel used in the third embodiment.

FIG. 28 shows a part of a menu hierarchy in the operation panel used in the present embodiment. The menu hierarchy includes an envelope size setting screen menu (2901) via which the size of an envelope to be printed is set, and an envelope weight setting screen menu (2902) via which the weight of the envelope to be printed is set. The MPU 1901 determines the postage on the basis of values input via the two setting screens. The MPU 1901 then performs a printing operation of printing an impression on the envelope according to the postage.

The hierarchy menu further includes an advertisement setting screen menus (2903, 2904, and 2905) via which advertisements in print buffers F1 to F3 are to be printed. An input operation is performed on each of the screens to set whether or not to print the advertisement corresponding the print buffers F1 to F3.

Figure 25A:
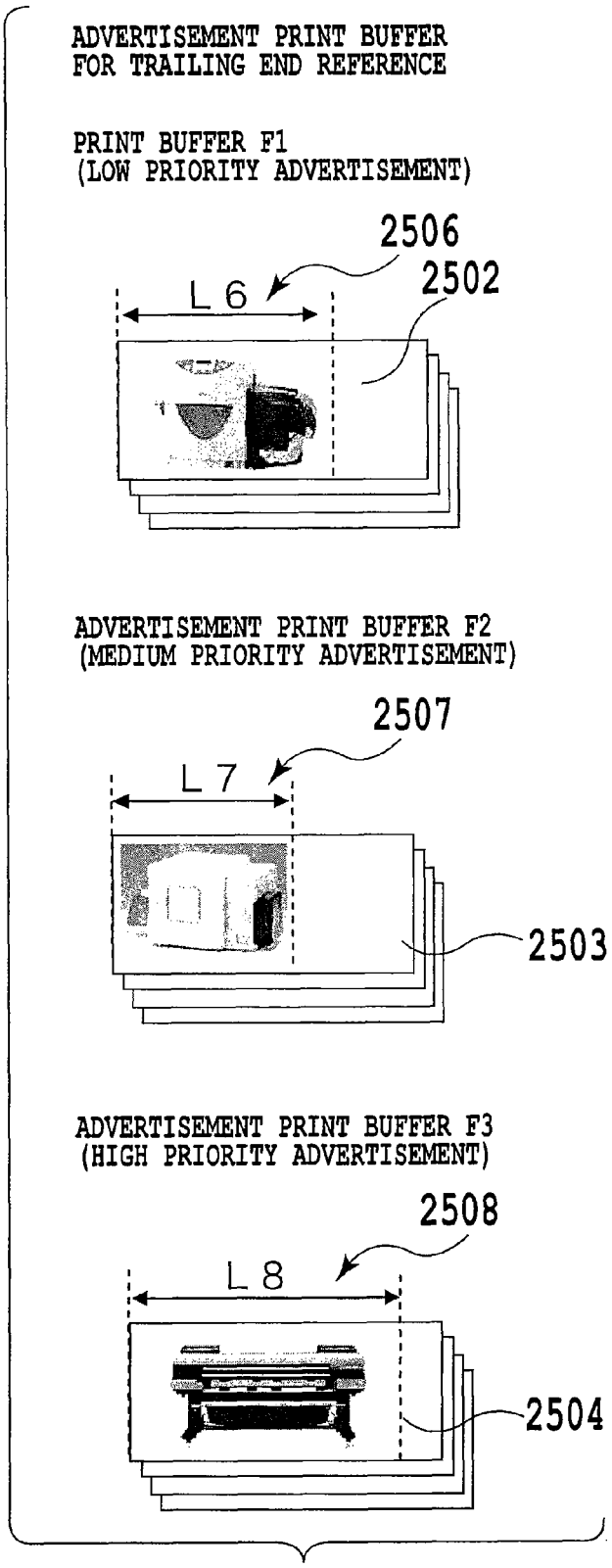
FIG. 25A is a diagram conceptually showing trailing end-based print data stored in print buffers F1 to F3 in the ink jet printing apparatus according to the third embodiment.
Figure 25B:
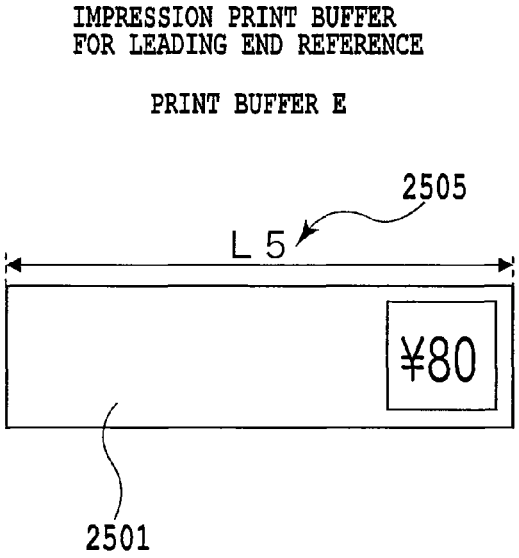
FIG. 25B is a diagram conceptually showing leading end-based print data stored in a print buffer E in the ink jet printing apparatus according to the third embodiment.

FIGS. 25A and 25B show the structure of print buffers used in the present embodiment. Data on an impression image is expanded into a print buffer E (2501) that is an impression print buffer for printing based on the leading end. The print length on an envelope is L5 (2505). Advertisement images are expanded into the print buffers F1 to F3 (2502, 2503, and 2504), advertisement print buffers for printing based on the trailing end. The print lengths of the advertisements used in the present embodiment are L6 (2506), L7 (2507), and L8 (2508), respectively. Data on an image formed only of a special color is expanded into the print buffer E (2501), which is thus made up of one layer. In contrast, data on a color image is expanded into each of the print buffers F1 to F3 (2502, 2503, and 2504), which is thus made up of four layers for black, cyan, magenta, and yellow. These print buffers are present on a video RAM 2704 (see FIG. 27) in the printing apparatus.

Furthermore, priorities for printing are predetermined for the print buffers F1 to F3 (2502, 2503, and 2504). The print buffers F1 (2502), F2 (2502), and F3 (2503) have a low priority, a medium priority, and a high priority, respectively. If the size of the envelope to be printed is insufficient to allow all the advertisements to be printed thereon, the advertisements with the higher priorities are printed.

Figure 26A:
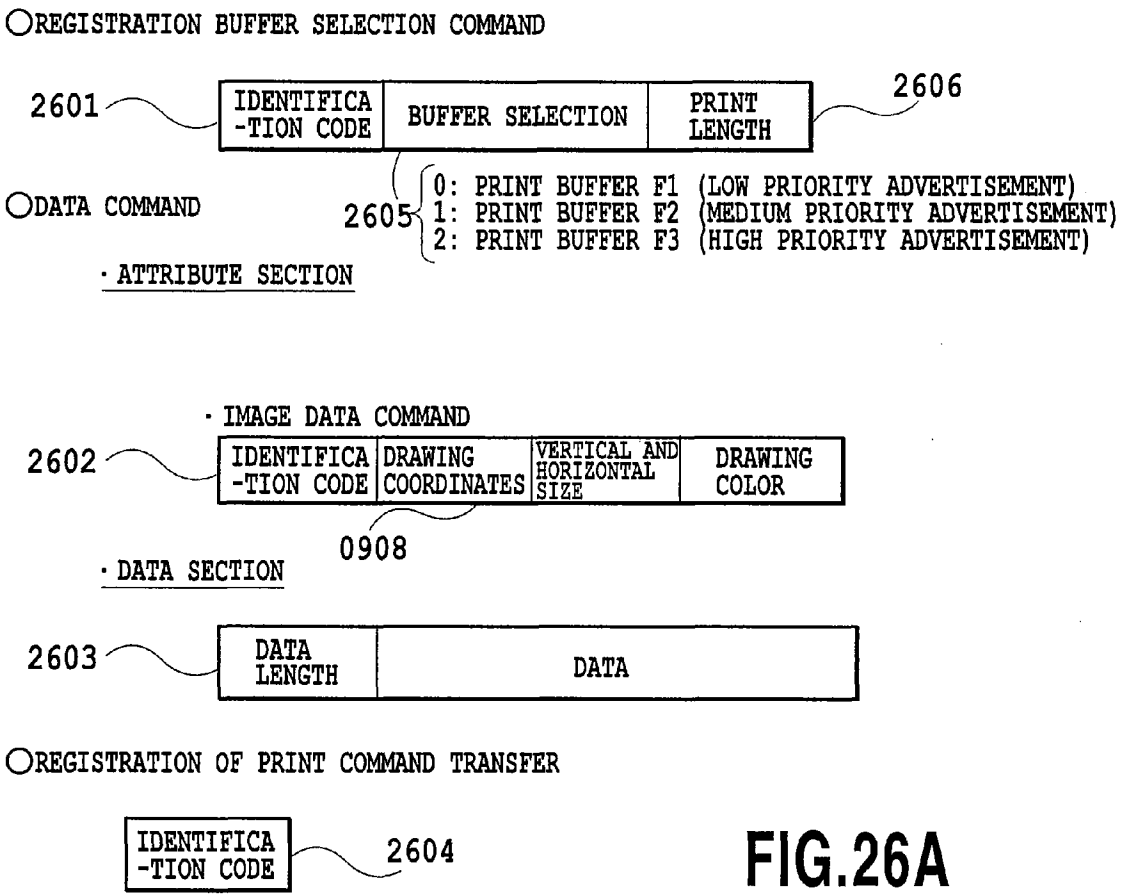
FIG. 26A is a diagram illustrating a control command system used in the ink jet printing apparatus according to the third embodiment.

FIG. 26A shows the structure of control commands used in the present embodiment. These control commands are used to register print data in the printing apparatus. A buffer selection parameter (2605) in a registration buffer selection command (2601) is used to select in which of the print buffers F1 to F3 (2502, 2503, and 2504) print data is to registered. According to the present embodiment, a buffer selection parameter (2605) of "0" indicates selection of the print buffer F1 (2502). A buffer selection parameter (2605) of "1" indicates selection of the print buffer F2 (2503). A buffer selection parameter (2605) of "2" indicates selection of the print buffer F3 (2504). Values (2606, 2507, and 2508) indicate the print lengths of the print buffers. When the advertisements for in the present embodiment are registered, the "print length (2606) of the print buffer F1=L6", the "print length (2607) of the print buffer F2=L7", and the "print length (2608) of the print buffer F3=L8".

Figure 26B:
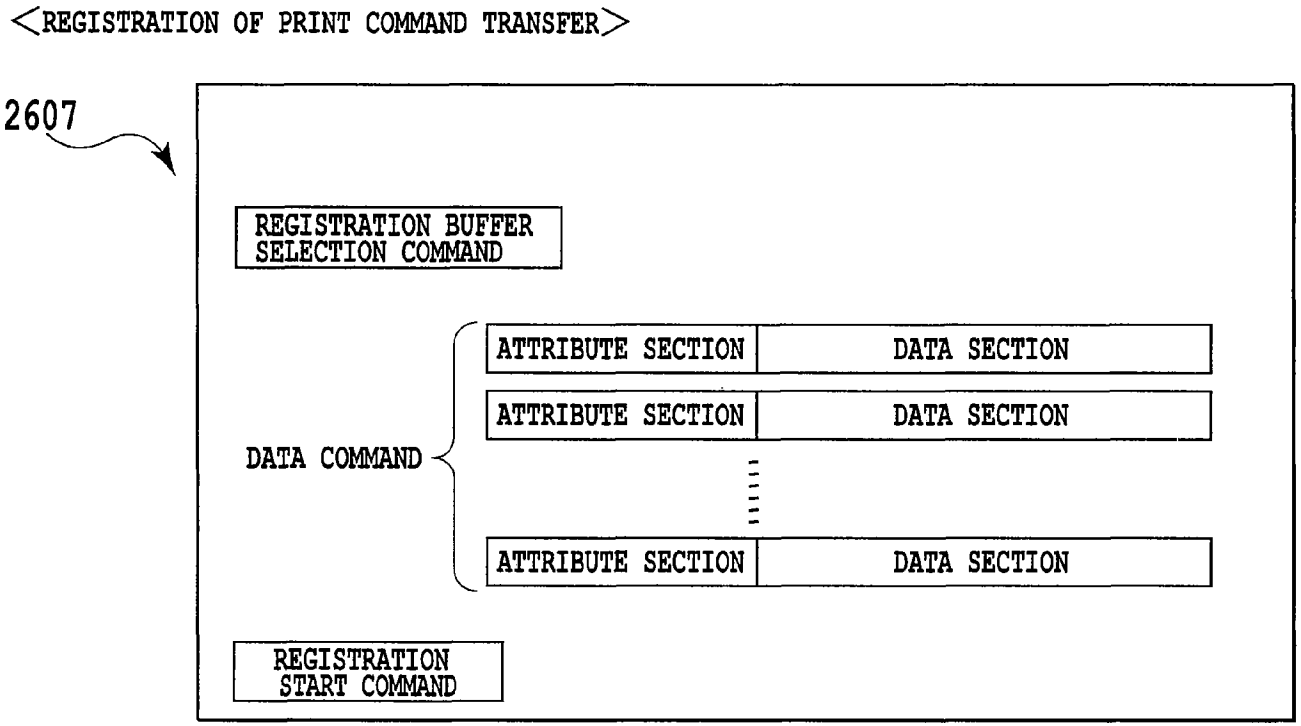
FIG. 26B is a diagram showing an example of transfer of print commands used in the ink jet printing apparatus according to the third embodiment.

Data commands include an image data command (2602) containing various attributes of image data and a data section (2603) for image data. The data commands further include a registration start command (2604) which indicates the end of registered data and which starts registration in a flash ROM (2703; see FIG. 27) that is a rewritable nonvolatile memory. These control commands are output by the host computer as shown in FIG. 26B as an example of transfer (2607).

Figure 27:
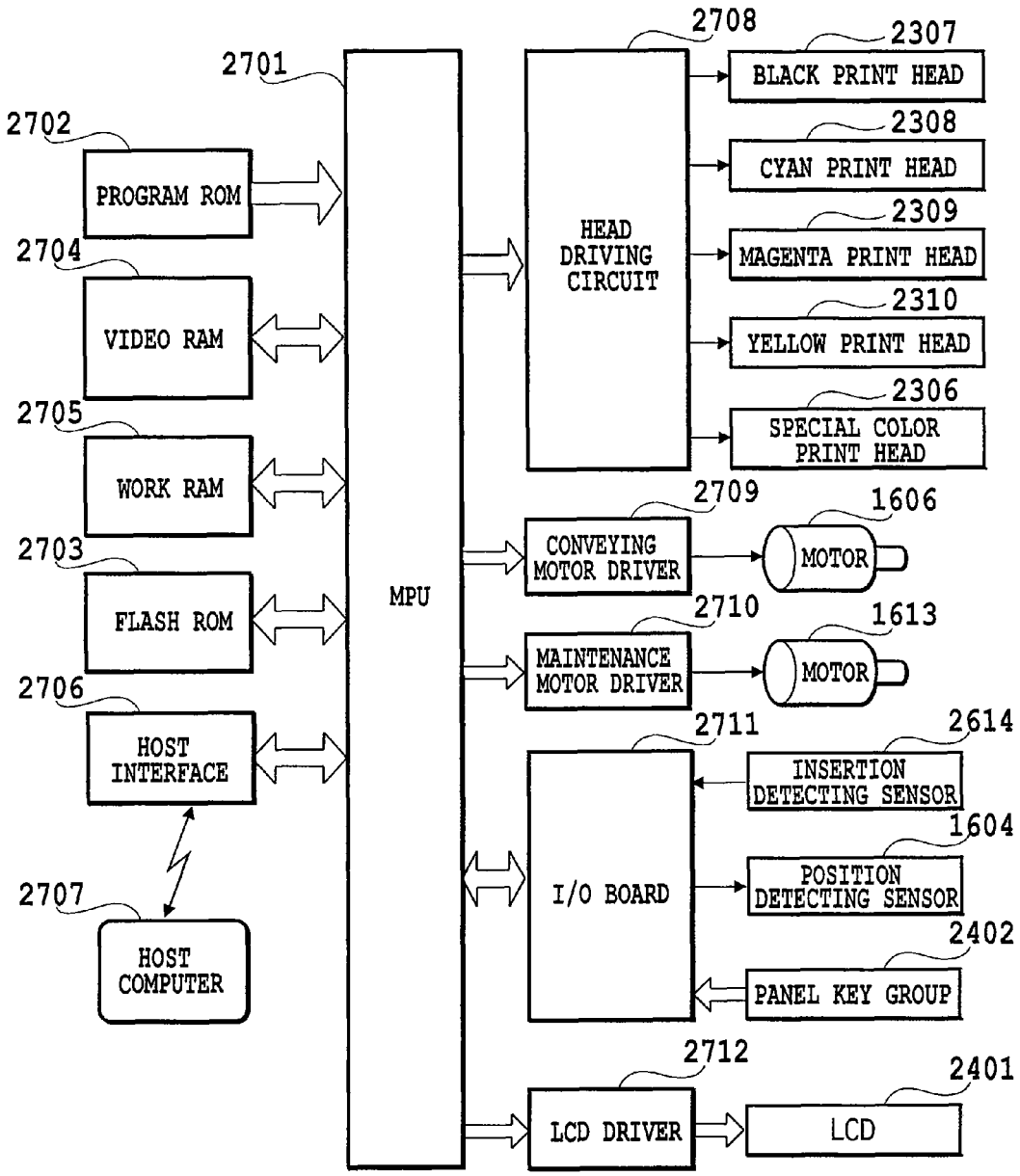
FIG. 27 is a block diagram showing a control system in the ink jet printing apparatus according to the third embodiment.

FIG. 27 shows a block diagram of a control system in the printing apparatus according to the present embodiment.

An MPU (2701) executes a control program stored in the program ROM (2702) to perform control described below.

The MPU (2701) controllably allows a host interface (2706) to receive any of the various control commands output by a host computer (2707). If the received command is the registration buffer selection command (2610), the buffer selection parameter (2605) is saved in an area Q on a work RAM (2705). Then, in accordance with the value of the buffer selection parameter saved in the area Q, the value of the print length (2606) is saved in one of the areas "R1 (the print length of the print buffer F1)", "R2 (the print length of the print buffer F2)", and "R3 (the print length of the print buffer F3)" on the work RAM (2705). To register the advertisements used in the present embodiment, "R1=L6 (2506)", "R2=L7 (2507)", and "R3=L8 (2508)" are saved.

If the received control command is the image data command (2602), the image data (2603) is expanded into the print buffer specified by Q (buffer selection parameter), in accordance with the attribute parameters in the image data command. If the received control command is the registration start command (2604), the data in the print buffer specified by Q (buffer selection parameter) and the print length are registered in the flash ROM (2703), which is a rewritable nonvolatile memory.

Furthermore, the MPU (2701) controllably allows a conveying motor driver (2709) and a maintenance motor driver (2710), to drive the conveying motor (1606) and the maintenance motor (1613). The MPU (2701) monitors signals output by the insertion detecting sensor (1614) and the position detecting sensor (1604), via an I/O port (2711) to obtain information on the insertion of an envelope into the sheet feeding port and the positions of the leading and trailing end of the envelope being conveyed. The MPU (2701) further controls a head driving circuit (2708) on the basis of the print data stored in the print buffers, at a timing for starting a printing operation, so that the print heads (2306, 2307, 2308, 2309, and 2310) ejects ink to print the envelope. The MPU (2701) further controllably drives the LCD (2401) via an LCD driver (2712) to display various messages.

Figure 29:
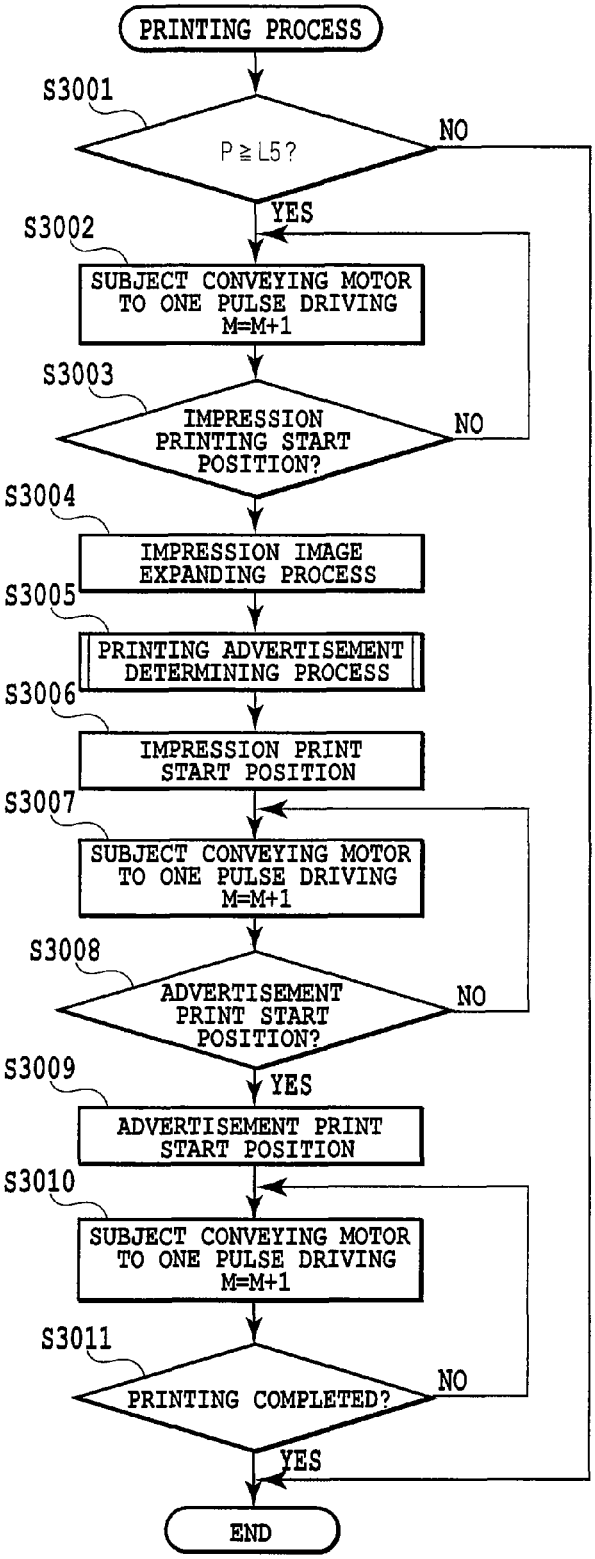
FIG. 29 is a flowchart showing the procedure of a printing process executed in the ink jet printing apparatus according to the third embodiment.

The process executed by the MPU in the printing apparatus according to the third embodiment will be described below. The process executed by the printing apparatus according to the third embodiment is similar to the main process described in the second embodiment with reference to FIG. 20. However, in the third embodiment, a printing process shown in the flowchart in FIG. 29 is executed in accordance with a control program stored in the program ROM (2702). This printing process will be described below.

First, if the printable length P (envelope size) of the envelope is less than L5 (the print length of the impression) (the determination result in S3001 is NO), not the entire area of the impression image expanded in the print buffer E (2505) can be printed. Thus, the process is terminated.

The third embodiment adopts a method of providing a margin at each of the leading and trailing ends of the envelope in the conveying direction. Thus, the printable length P of the envelope corresponds to the length of the envelope in the conveying direction minus the sum of a top margin and a bottom margin of the envelope.

Then, the MPU (2701) drives the conveying motor in response to driving pulse signals and increments M (the count in the envelope position counter) for each driving pulse (S3002). Then, on the basis of the count, the MPU (2701) determines whether or not the leading end of the envelope has reached the position of the impression print head (2306), corresponding to the print start position (S3003). When the leading end of the envelope reaches the print start position of the impression print head (the determination result in S3003 is YES), the MPU (2701) calculates the postage on the basis of the "envelope size" and "envelope weight" input via the operation panel. The MPU (2701) further expands an impression image based on the postage into the print buffer E (2501). Moreover, the MPU (2701) determines an advertisement image (tailing end-based image) to be printed (S3005) and starts printing the impression image (S3006).

Then, the MPU (2701) drives the conveying motor in response to driving pulse signals and increments M (the count in the envelope position counter) for each driving pulse (S3007) Then, when the print start position of the advertisement image (trailing end-based image) determined in the above-described print advertisement determining step (S3005) reaches the print heads for printing color images (the determination result in 53008 is YES), the MPU (2701) starts printing the advertisement image determined in the above-described step S3005 (S3009). The MPU (2701) then subjects the conveying motor to pulse driving and increments M (the count in the envelope position counter) (S3010). When the printing of the advertisement image is finished (YES in S3011), the printing process is completed.

Figure 30:
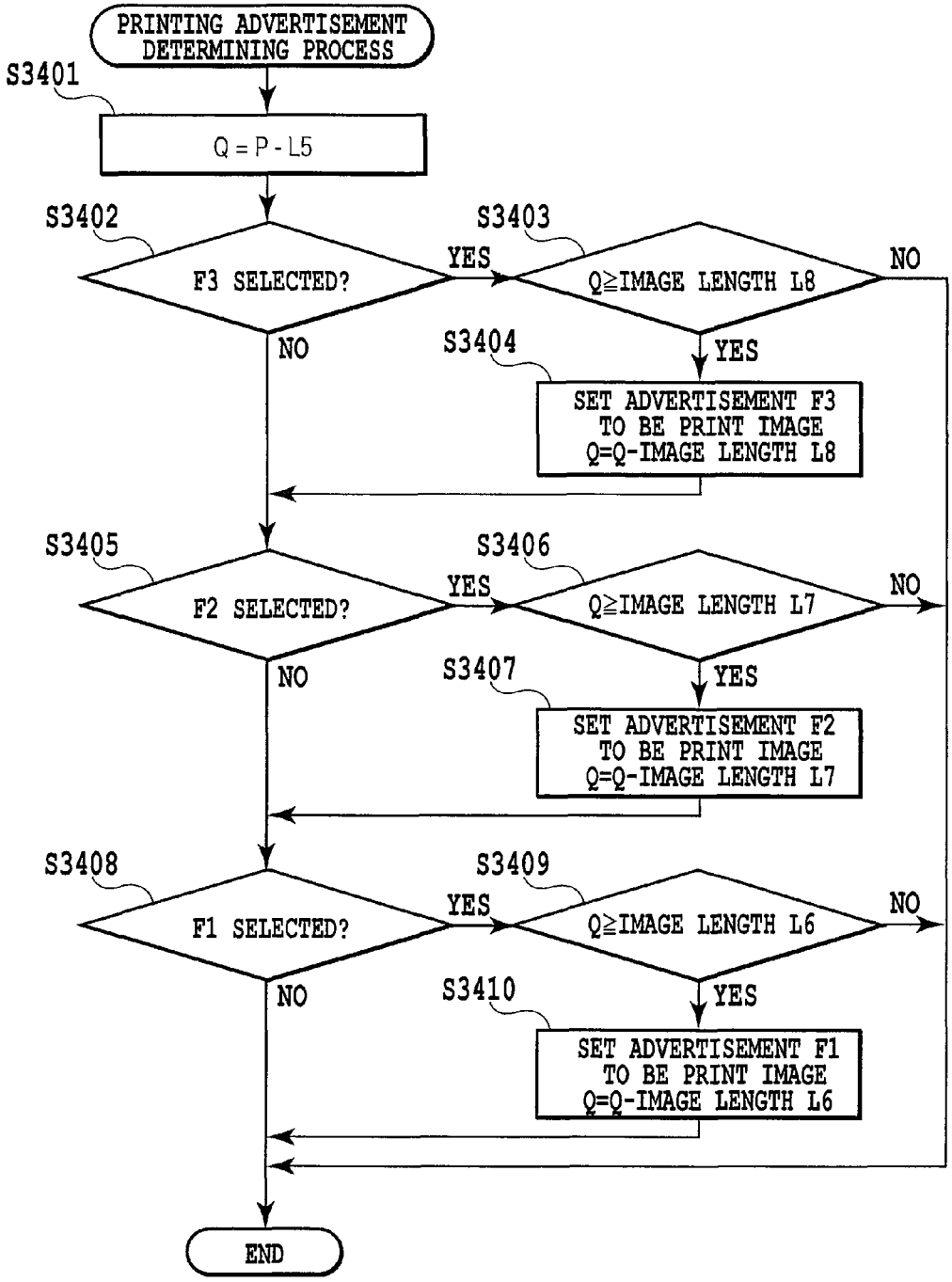
FIG. 30 is a flowchart showing a process of determining those of advertisements in the print buffers F1 to F3 which are to be printed according to the third embodiment.

Now, the process of determining those of the advertisements in the print buffers F1 to F3 which are to be printed according to the third embodiment will be described with reference to the flowchart in FIG. 30.

An advertisement printable length in the conveying direction over which an advertisement image can be printed is defined as a parameter Q. The size LS of the impression image is subtracted from the conveying-direction printable length P of the enveloped used, and the difference is defined as a parameter Q (S3401). As described above, the printable length P of the envelope corresponds to the length of the envelope in the conveying direction minus the sum of the top and bottom margins of the envelope.

Then, the MPU (2701) checks whether or not the print buffer F3 with the high priority has been selected. Here, upon determining that the print buffer F3 has been selected (the determination result in S3402 is YES), the MPU (2701) determines whether or not the size L8 of the print buffer F3 is equal to or smaller than the advertisement printable length Q. Here, if the MPU (2701) determines that the size L8 of the print buffer F3 is equal to or smaller than the advertisement printable length Q, that is, if the MPU (2701) determines that the envelope still has a print length over which the image in the print buffer F3 can be printed (the determination result in S3403 is YES), the MPU (2701) sets the image in the print buffer F3 to be a print image. Then, the MPU (2701) subtracts the size L8 from the currently set advertisement printable length Q to rewrite the advertisement printable length Q with the new value obtained (S3404).

Subsequently, the MPU (2701) checks whether or not the print buffer F2 with the medium priority has been selected. Here, if the print buffer F2 has been selected (the determination result in S3405 is YES), the MPU (2701) determines whether or not the size L7 of the print buffer F2 is equal to or smaller than the advertisement printable length set for Q. If the size L7 is equal to or smaller than the value Q, that is, the remaining size of the envelope is enough to allow the data in the print buffer F2 to be printed thereon (the determination result in S3406 is YES), the MPU (2701) sets the image in the print buffer F2 to be the print image. Then, the MPU (2701) further subtracts the size L7 from the value for the print buffer F2 to rewrite the advertisement printable length Q with the new value obtained (S3407).

Finally, the MPU (2701) checks whether or not the print buffer F1 with the lowest priority has been selected. Here, if the print buffer F1 has been selected (the determination result in S3408 is YES), the MPU (2701) determines whether or not the size of the print buffer F1 is equal to or smaller than the current advertisement printable length Q. If the MPU (2701) determines that the size of the print buffer F1 is equal to or smaller than the current printable length Q, that is, the remaining size of the envelope is enough to allow the image in the print buffer F1 to be printed thereon (the determination result in S3409 is YES), the MPU (2701) sets the image in the print buffer F1 to be the print image. Then, the MPU (2701) further subtracts the size L6 from the value for the print buffer F1 to rewrite the advertisement printable length Q with the new value obtained (S3410). The MPU (2701) thus completes the printing process.

Furthermore, if in S3402, the print buffer F3 has not been selected (the determination result in S3402 is NO), the process proceeds to S3405. If in S3405, the print buffer F2 has not been selected (the determination result in S3405 is NO), the process proceeds to S3408. Similarly, if in S3408, the print buffer F1 has not been selected (the determination result in S3408 is NO), the printing process is completed.

Moreover, if in S3403, the value Q is determined to be less than L8 (the determination result in S3403 is NO), or in S3406, the value Q is determined to be less than L7 (the determination result in S3406 is NO), or in S3409, the value Q is determined to be less than L6 (the determination result in S3409 is NO), then the printing process is immediately terminated.

Figure 31A:
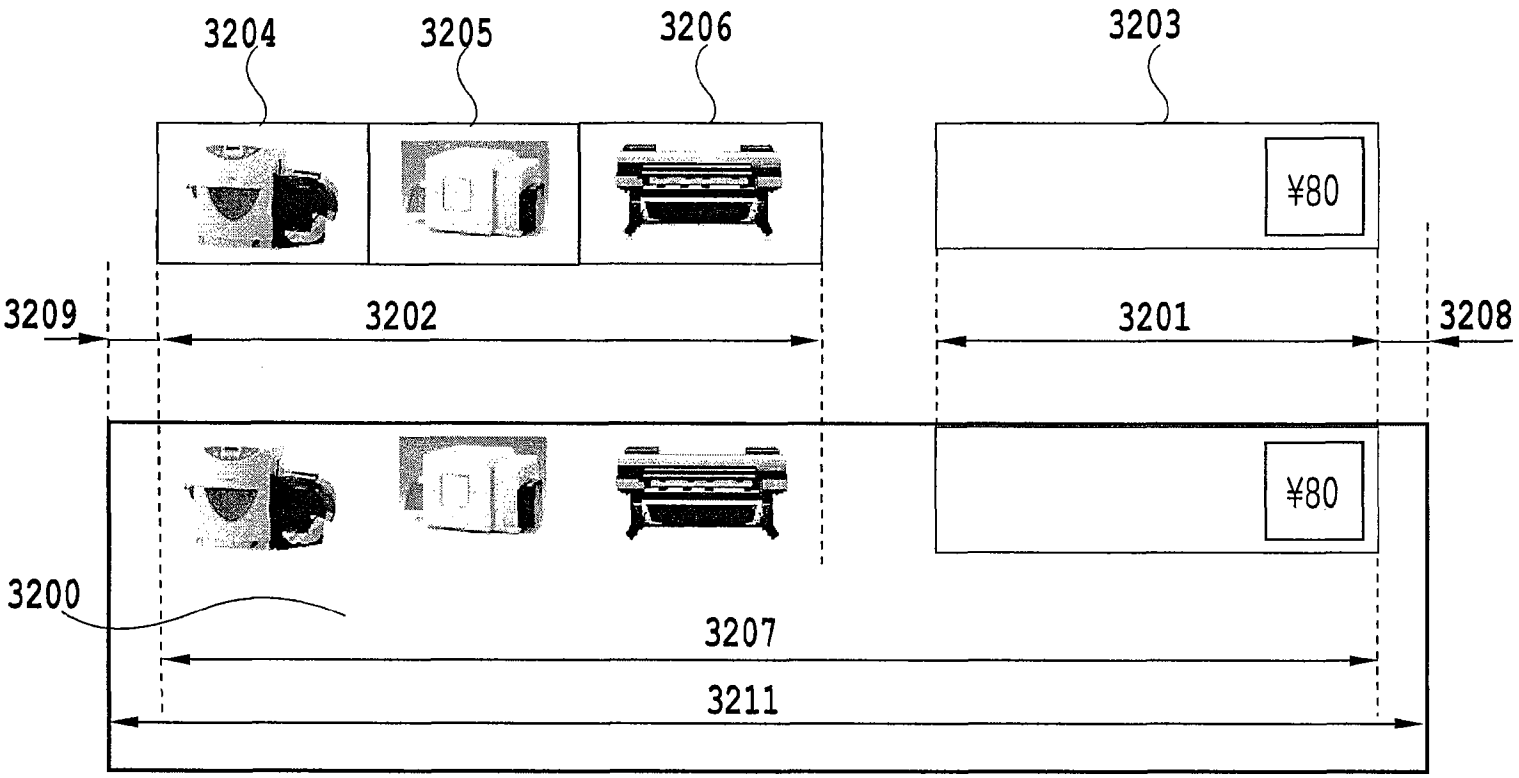
FIGS. 31A and 31B is a diagram showing the results of printing of envelopes of various print medium lengths by the ink jet printing apparatus according to the third embodiment.
Figure 31B:
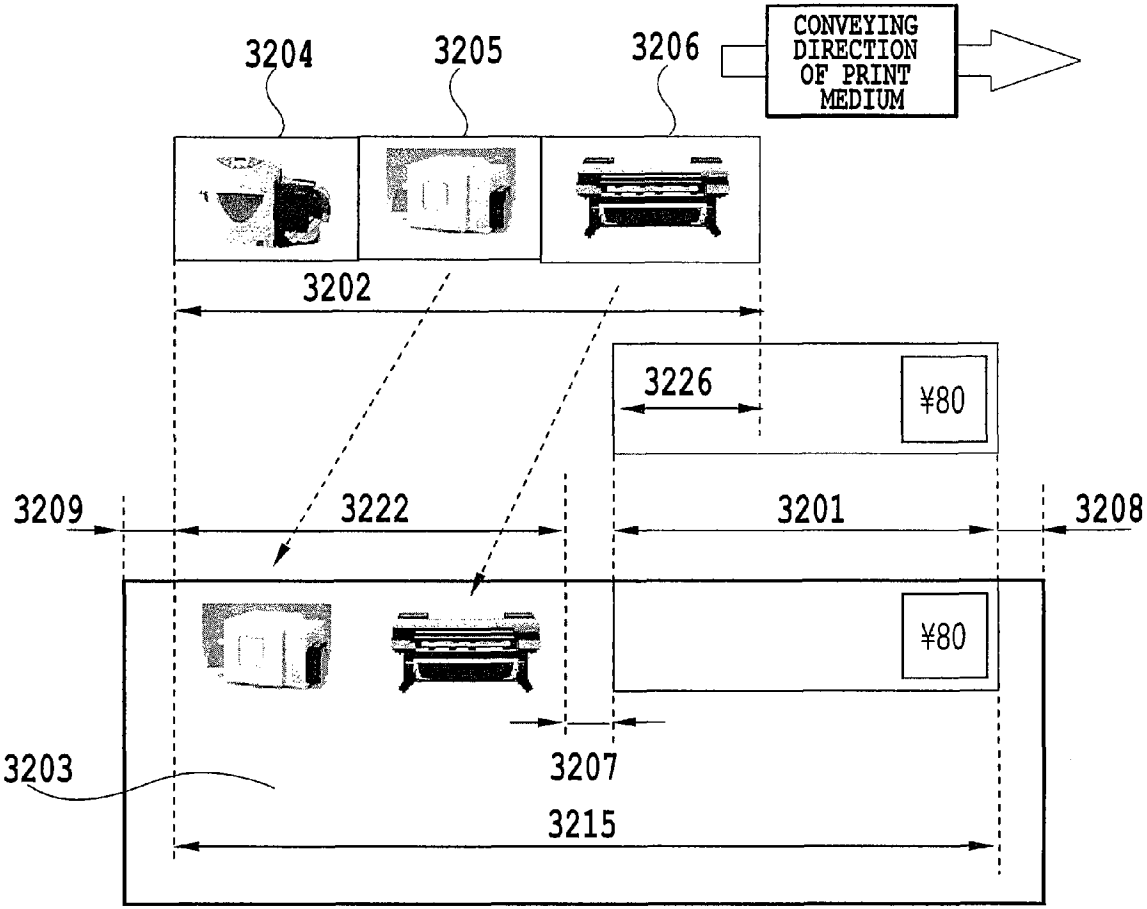

FIGS. 31A and 31B show an example of the results of the above-described process of printing an image on an envelope. FIG. 31A shows a printing result (3200) obtained when a print area (3201) of the print buffer E does not overlap a print area (3202) of the print buffer F. In the present embodiment, a top margin (3208) and a bottom margin (3209) are provided at the leading and trailing ends, respectively, of the print medium. Thus, a printable size (3207) is equal to a print medium size (3211) minus the sum of the top margin (3208) and the bottom margin (3209).

FIG. 31B shows a printing result obtained when, within a printable size (3215) of the print medium, the print area (3201) of the print buffer E and the print area (3202) of the print buffer F partly overlap in an area (3216).

In FIG. 31B, after printing of the print area of the print buffer E is completed, a print area (3222) from the head to middle of the print buffer F is printed. That is, in this example, an advertisement image 3204 written in the pint buffer with the lowest priority is excluded. Therefore, the third embodiment prevents the image from being discontinued and allows the completed leading end- and trailing end-based images to be printed on envelopes of various sizes in a well-balanced manner.

Other Embodiments

In the second and third embodiments, only one of the print buffer for the trailing end reference (second print buffer) and the print buffer for the leading end reference (first print buffer), that is, the second print buffer is made up of the plurality of layers. However, the first print buffer may be made up of a plurality of layers. Moreover, both the first and second print buffers may be made up of a plurality of layers. That is, according to the present invention, each the print data based on the trailing and leading ends may be composed of a plurality of data that can be stored in the plurality of print buffers.

Moreover, in the above-described third embodiment, if the leading end-based image and the trailing end-based image overlap, the print data with the high priority is selected from the trailing end-based image containing the print data on the plurality of images. However, when at least one of the leading end-based print data and the trailing end-based print data comprises print data on plural types of images, even if the leading end-based image and the trailing end-based image do not overlap, it is possible to select only required ones of the plurality of images for printing. That is, even if the print medium used is large enough to print all of the leading end-based image and the trailing end-based image, a plurality of images can be selectively printed.

In each of the above-described embodiments, the card printing apparatus based on the ink jet method using the line print head is taken as an example. However, the present invention is not limited to this aspect but is effective regardless of the printing method or the type of the print medium; the present invention is effectively applied to a serial ink jet printing apparatus that scans print media in a direction (main scanning direction) orthogonal to the conveying direction (sub-scanning direction) of the print medium, a printing apparatus based on a heat transfer method and using an ink ribbon, a label printing apparatus printing continuous forms (tag paper/label paper).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-169893, filed Jun. 28, 2007, which is hereby incorporated by reference herein in its entirety.

What is claimed is:

1. A printing apparatus comprising:

an end detecting unit configured to detect a leading end and a trailing end of a print medium; and a print controller configured (i) to allow print data to be selectively specified as printed on an image print area of the print medium on the basis of the leading end of the print medium or printed on an image print area of the print medium on the basis of the trailing end of the print medium, (ii) to perform printing of first print data of which print position is specified at a first position on the print medium, the first position being determined on the basis of the leading end of the print medium detected by the end detecting unit, and (iii) to perform printing of second print data of which print position is specified at a second position on the print medium such that (a) printing of all of the second print data, which is data input into the printing apparatus, is performed or (b) a start position of printing of the second print data is changed, the second position being determined on the basis of the trailing end of the print medium detected by the end detecting unit independently of the first position.

2. The printing apparatus according to claim 1, further comprising an overlapping area identifying unit configured to identify an area in which the first print data and the second print data overlap, wherein the print controller is configured to print the area identified by the overlapping area unit on the basis of print data obtained by determining a logical sum of the first print data and the second print data.

3. The printing apparatus according to claim 1, further comprising an overlapping area identifying unit configured to identify an overlap area in which the first print data overlaps the second print data, wherein the print controller is configured to print the area identified by the overlapping area identifying unit the basis of one of the first print data and the second print data.

4. The printing apparatus according to claim 2, wherein at least one of the first print data and the second print data contains print data on a plurality of different images to be printed at different positions on the print medium, and the print controller is configured to select at least one of the plurality of images which can be printed within the print medium to perform printing only on the basis of the print data on the selected image.

5. The printing apparatus according to claim 2, wherein at least one of the first print data and the second print data contains print data on a plurality of different images to be printed at different positions on the print medium, and if the overlap area is present, the print controller is configured to select at least one of the plurality of images which can be printed within the print medium to perform printing only on the basis of the print data on the selected image.

6. The printing apparatus according to claim 3, wherein the first print data and the second print data are given priorities, and if the overlap area is present, the overlap area is printed on the basis of one of the first print data and the second print data which has a higher priority.

7. The printing apparatus according to claim 2, wherein the second print data contains print data on a plurality of images to be printed at different positions on the print medium, and if the overlap area is present, the print controller is configured to select at least one of the plurality of images which can be printed in a remaining print area resulting from subtraction of a print area of an image printed on the basis of the first print data, from a print area on the print medium.

8. The printing apparatus according to claim 6, wherein a plurality of print image data contained in the second print data are given priorities, and the print controller is configured to perform printing on the basis of print data on an image which can be printed in a remaining part of the print area of the print medium and which has a high priority.

9. The printing apparatus according to claim 1, wherein the first print data and the second print data contain reference position setting information indicating which of the leading end and trailing end of the print medium is set to be a reference position.

10. A printing method comprising:

a leading end detecting step of detecting a leading end of a print medium;

a trailing end detecting step of detecting a trailing end of the print medium;

a selectively specifying step of selectively specifying print data to be printed on an image print area of the print medium on the basis of the leading end of the print medium or printed on an image print area of the print medium on the basis of the trailing end of the print medium;

a first printing step of performing printing of first print data of which print position is specified at a first position on the print medium, the first position being determined on the basis of the leading end of the print medium detected in the leading end detecting step; and a second printing step of performing printing of second print data of which print position is specified at a second position on the print medium such that (a) printing of all of the second print data, which is data input into the printing apparatus, is performed or (b) a start position of printing of the second print data is changed, the second position being determined on the basis of the trailing end of the print medium detected in the trailing end detecting step independently of the first position.

11. A printing apparatus comprising:

a leading end detecting unit configured to detect a leading end of a print medium;

a trailing end detecting unit configured to detect a trailing end of a print medium; and a print controller configured (i) to allow print data to be selectively specified as printed on an image print area on the print medium on the basis of the leading end of the print medium or printed on an image print area of the print medium on the basis of the trailing end of the print medium, (ii) to perform printing of first print data of which print position is specified on the basis of the leading end on the print medium, the leading end being detected by the leading end detecting unit, and (iii) to perform printing of second print data of which print position is specified on the basis of the trailing end on the print medium, the trailing end being detected by the trailing end detecting unit.

12. The printing apparatus according to claim 11, further comprising an overlapping area identifying unit configured to identify an overlap area in which the first print data and the second print data overlap, wherein the print controller is configured to print the area identified by the overlapping area identifying unit on the basis of print data obtained by determining a logical sum of the first print data and the second print data.

13. The printing apparatus according to claim 11, further comprising an overlapping area identifying unit configured to identify an overlap area in which the first print data and the second print data overlap, wherein the print controller is configured to print the area identified by the overlapping area identifying unit on the basis of any one of the first print data and the second print data.

14. The printing apparatus according to claim 11, wherein at least one of the first print data and the second print data contains print data on a plurality of different images to be printed at different positions on the print medium, and the print controller is configured to select at least one of the plurality of different images which can be printed within the print medium to perform printing only on the basis of the print data on the selected image.

15. The printing apparatus according to claim 11, further comprising an overlapping area identifying unit configured to identify an overlap area in which the first print data and the second print data overlap, wherein at least one of the first print data and the second print data contains print data on a plurality of different images to be printed at different positions on the print medium, and wherein if the overlap area is present, the print controller selects at least one of the plurality of different images which can be printed within the print medium to perform printing only on the basis of the print data on the selected image.

16. The printing apparatus according to claim 11, further comprising an overlapping area identifying unit configured to identify an overlap area in which the first print data and the second print data overlap, wherein the second print data contains print data on a plurality of different images to be printed at different positions on the print medium, and wherein if the overlapping area is present, the print controller selects at least one of the plurality of different images which can be printed in a remaining print area resulting from subtraction of a print area of an image printed on the basis of the first print data, from print area on the print medium to perform printing only on the basis of the print data on the selected image.

17. The printing apparatus according to claim 11, wherein each of the first print data and the second print data contains print reference position setting information indicating which of the leading end or trailing end of the print medium is set to be a reference position.

18. The printing apparatus according to claim 11, wherein the print controller is configured to perform printing on the basis of the first print data and the second print data on the same surface of the print medium.

19. A printing method comprising:

a leading end detecting step of detecting a leading end of a print medium;

a trailing end detecting step of detecting a trailing end of the print medium;

a selectively specifying step of selectively specifying print data to be printed on an image print area of the print medium on the basis of the leading end of the print medium or printed on the image print area of the print medium on the basis of the trailing end of the print medium;

a first printing step of performing printing of first print data of which print position is specified on the basis of the leading end on the print medium, the leading end being detected in the leading end detecting step; and a second printing step of performing printing of second print data of which print position is specified on the basis of a trailing end of print medium, the trailing end being detected in the trailing end detecting step.

* * * * *